US010648179B2

(12) United States Patent
Baird

(10) Patent No.: US 10,648,179 B2
(45) Date of Patent: May 12, 2020

(54) AUTOMATIC ROOF SHINGLE REMOVAL AND INSTALLATION SYSTEM

(71) Applicant: Michael Baird, Lakewood, OH (US)

(72) Inventor: Michael Baird, Lakewood, OH (US)

( * ) Notice: Subject to any disclaimer, the term of this patent is extended or adjusted under 35 U.S.C. 154(b) by 0 days.

(21) Appl. No.: 15/917,234

(22) Filed: Mar. 9, 2018

(65) Prior Publication Data

US 2019/0032338 A1 Jan. 31, 2019

Related U.S. Application Data

(62) Division of application No. 15/659,630, filed on Jul. 26, 2017, now Pat. No. 9,945,128.

(51) Int. Cl.
*E04D 15/00* (2006.01)
*E04D 15/02* (2006.01)
*E04D 15/07* (2006.01)

(52) U.S. Cl.
CPC ..... *E04D 15/02* (2013.01); *E04D 15/003* (2013.01); *E04D 15/07* (2013.01)

(58) Field of Classification Search
None
See application file for complete search history.

(56) References Cited

U.S. PATENT DOCUMENTS 2,814,533 A * 11/1957 Van Horn ..... E04G 3/26 182/129
3,093,936 A * 6/1963 Figge ..... E04D 15/06 126/343.5 A
3,122,862 A * 3/1964 Figge ..... E04D 11/02 156/575
3,245,192 A * 4/1966 Hilson ..... E04D 15/04 156/574
3,842,934 A * 10/1974 Bartlett ..... E04D 15/02 182/37
3,983,676 A * 10/1976 Gilpin ..... E04D 15/04 52/749.12
4,269,450 A * 5/1981 Welborn ..... E04D 15/003 180/19.1
4,294,046 A * 10/1981 Damiano ..... E01B 31/00 104/307
4,656,808 A 4/1987 Mansfield
4,700,526 A * 10/1987 McGuinness ..... E04D 15/02 227/111
4,993,207 A * 2/1991 Burke ..... E04D 15/02 221/185
5,054,576 A * 10/1991 Glynn ..... A62B 35/04 182/3
5,169,048 A * 12/1992 Himebaugh ..... B27F 7/006 227/111
5,197,257 A * 3/1993 Nietling ..... E04D 15/02 182/45
5,205,103 A * 4/1993 Burton ..... E04D 15/02 182/45
5,218,766 A 6/1993 Himebaugh
(Continued)

*Primary Examiner* — Kyle J. Walraed-Sullivan
(74) *Attorney, Agent, or Firm* — Christopher Pilling

(57) ABSTRACT

A system for removing shingles on a roof is provided. One embodiment includes a navigational apparatus for traversing the roof and a roof shingle removal apparatus attached to the navigational apparatus for removing the shingles. The improved removal apparatus pries existing shingles from the roof, and then stores the shingles in a debris bin before emptying the shingles in a precise location.

9 Claims, 25 Drawing Sheets

(56) References Cited

U.S. PATENT DOCUMENTS 5,381,597 A 1/1995 Petrove
5,758,743 A * 6/1998 Coyle ..... A62B 35/0068 182/45
6,101,782 A * 8/2000 Abney ..... E04D 15/06 242/557
6,113,340 A * 9/2000 Zalal ..... B66B 9/193 414/598
6,527,156 B2 * 3/2003 McAllister ..... B27F 7/006 227/111
6,611,738 B2 * 8/2003 Ruffner ..... A01B 69/008 701/23
D485,657 S * 1/2004 Lewis ..... D34/28
7,419,078 B2 * 9/2008 Hannan ..... B27F 7/02 227/110
7,552,976 B2 6/2009 Brown
7,802,854 B1 9/2010 Lane et al.
8,033,205 B2 * 10/2011 Cross ..... E04D 15/003 299/37.1
8,650,989 B1 * 2/2014 Bremer, Jr. ..... E04D 15/003 30/170
2004/0050896 A1 * 3/2004 Ballent, Jr. ..... B27F 7/006 227/2
2004/0074695 A1 * 4/2004 Henry ..... A62B 35/0068 182/3
2004/0083679 A1 * 5/2004 Shinn ..... E04D 15/003 52/749.12
2004/0155087 A1 * 8/2004 Hamlin ..... B27F 7/006 227/110
2005/0189171 A1 * 9/2005 Bos ..... E04G 21/3261 182/36
2006/0117910 A1 * 6/2006 Gendron ..... E04D 15/003 81/45
2006/0260260 A1 * 11/2006 Blackford ..... E04D 13/12 52/698
2007/0000354 A1 * 1/2007 Tyler ..... E04D 15/003 81/45
2007/0151422 A1 * 7/2007 Kingham ..... E04D 15/003 81/45
2007/0164597 A1 * 7/2007 Brown ..... E04D 15/003 299/39.1
2007/0261340 A1 * 11/2007 Cecilio ..... E04B 1/762 52/311.1
2010/0272553 A1 * 10/2010 Aschenbeck ..... B65G 57/081 414/788.3
2012/0042603 A1 2/2012 Cross
2014/0123568 A1 * 5/2014 Nurdogan ..... E04D 1/30 52/57
2017/0204614 A1 * 7/2017 Ragula ..... E04D 15/06

* cited by examiner

AUTOMATIC ROOF SHINGLE REMOVAL AND INSTALLATION SYSTEM

CROSS-REFERENCE TO RELATED APPLICATIONS

This application is a divisional of application Ser. No. 15/659,630 filed Jul. 26, 2017.

BACKGROUND OF THE INVENTION

1. Field of the Invention

The present invention generally relates to roof shingle removal and installation, but more particularly to an automatic roof shingle removal and installation system.

2. Description of Related Art

It is well known that the removal and installation of roof shingles is a repetitive and hazardous task. Before installing new roof shingles, the removal of the existing roof shingles is required. Currently, various systems and methods for roof shingle removal exist. Some systems include prying devices that require extensive manual labor to operate. Other systems include machinery mounted to a truck that require the home to have clear access free of trees, porches, and other obstructions that would prevent a truck from driving the perimeter of the home. Other systems include guide systems for the debris that is onerous to install. Other automated systems include machinery that allow the debris to slide down the roof as it is removed potentially falling on vegetation or the ground requiring manual cleanup.

Likewise, systems and methods for roof shingle installation also exist. Some systems include manually operated installation tools that improve efficiency while still being dangerous and labor intensive. The roof shingle systems of the prior art have multiple deficiencies including (a) inability to overhang the roof's rake edge to complete a full row of material installation; (b) mechanical fastener mounting unable to adjust nail placement complying with different building codes and shingle manufacturer's installation instructions; (c) mounting of guide rails requiring extensive set-up time for the operator; (d) larger apparatus sizes are unable to install roof material closer to the peak of a roof; (e) inability to flip shingles as they are separated from the bundle as shingle manufacturers package bundles so every other shingle if facing a different direction to avoid the tar from sticking together destroying the new roof shingles; (f) inability to precisely stagger the seams according to different shingle manufacturer installation specification; and (g) mechanical fastener mountings prevents systems from leaving one nail unfastened around chimneys, valleys, vents, and other obstructions so the roofer can finish the metal flashing.

Further, existing systems focus on either removing the old material or new roof shingle installation, requiring roofers to purchase additional equipment for every stage of the process. Consequently, there is a need to provide an automatic roof shingle removal and installation system that is faster, and requires less manual labor than existing systems.

BRIEF SUMMARY OF THE INVENTION

An automatic roof shingle installation system is provided, comprising: a roof shingle installation apparatus having a compartment configured to hold a bundle of shingles and a rotatable shingle peel member configured to separate a single shingle from the bundle of shingles and flip the single shingle.

In one embodiment, the roof shingle installation apparatus further comprises a shingle position member and at least one fastening member, wherein the shingle position member is configured to position the single shingle into position for fastening and the at least one fastening member is configured to fasten the single shingle to a roof, wherein the at least one fastening member is movable enabling precise locational control of fasteners corresponding to any shingle manufacture installation specification and building code requirement. In one embodiment, the shingle installation apparatus further comprises a cutting device configured to cut the single shingle at any angle and/or length necessary for installation.

In one embodiment, a navigational apparatus configured to traverse the roof is provided, the navigational apparatus comprising at least one movable drill assembly including at least one independently actuated drill having a fastening means preventing the navigational apparatus from slipping off the roof, and a mounting element configured to attach the roof shingle installation apparatus to the navigational apparatus such that the shingle installation apparatus is enabled to traverse the roof via the navigational apparatus. In another embodiment, the navigational apparatus further comprises a structural body housing a plurality of components including a microcontroller, a gyroscope, a wireless communication means, and an accelerometer, wherein the wireless communication means is used to communicate the navigational apparatus with a mobile device enabling an operator to safety control and monitor the system. In yet another embodiment, the navigational apparatus further comprises proximity sensors configured to detect an edge of the roof and a plurality of wheels, wherein the at least one movable drill assembly, the proximity sensors, and the position of the plurality of wheels enable the navigational apparatus with the attached roof shingle installation apparatus to overhang an edge of the roof allowing for the installation of shingles on an entire row of the roof increasing surface area coverage. In one embodiment, the navigational apparatus can traverse a hip roof and avoid obstructions without the use of guide rails, pulleys, or armatures. In one embodiment, the at least one movable drill assembly is a movable horizontal drill assembly and a movable vertical drill assembly, wherein the movable drill assemblies each include two independently actuated drills. In another embodiment, the gyroscope is configured to detect an angle of the navigational apparatus and the microcontroller can fasten one of the independently actuated drills of the vertical drill assembly, and push the navigational apparatus back into a level horizontal position such that the navigational apparatus is auto-leveling ensuring the navigational apparatus travels in straight lines.

In another aspect of the invention, an automatic roof shingle removal system is provided, comprising: a roof shingle removal apparatus including a prying member configured to pry existing shingles from a roof, wherein the existing shingles pried from the roof are stored in a debris bin. In one embodiment, the debris bin can be raised and/or lowered such that the existing shingles may be emptied in a precise location.

In another embodiment, a navigational apparatus configured to traverse the roof is provided, the navigational apparatus comprising at least one movable drill assembly including at least one independently actuated drill having a fastening means preventing the navigational apparatus from slipping off the roof, and a mounting element configured to attach the roof shingle removal apparatus to the navigational apparatus such that the shingle removal apparatus is enabled to traverse the roof via the navigational apparatus.

In one embodiment, the navigational apparatus further comprises a structural body housing a plurality of components including a microcontroller, a gyroscope, a wireless communication means, and an accelerometer, wherein the wireless communication means is used to communicate the navigational apparatus with a mobile device enabling an operator to safety control and monitor the system. In another embodiment, the navigational apparatus further comprises proximity sensors configured to detect an edge of the roof and a plurality of wheels, wherein the at least one movable drill assembly, the proximity sensors, and the position of the plurality of wheels enable the navigational apparatus with the attached roof shingle removal apparatus to overhang an edge of the roof allowing for the removal of shingles on the edge covering greater surface area. In yet another embodiment, the roof shingle removal apparatus further comprises least one cutting element configured to cut the existing shingles from the roof and wherein the microcontroller enables the navigational apparatus with the attached roof shingle removal apparatus to located a position of a debris collection container on a ground surface adjacent to the edge of the roof such that the existing shingles stored in the debris bin can be deposited directly into the debris collection container; and wherein the roof shingle removal apparatus further comprises a debris shoot positioned at a top portion of the debris bin allowing the deposited existing shingles to clear gutters when deposited into the debris collection container.

In yet another aspect of the invention a system is provided, comprising: a navigational apparatus configured to traverse a roof, the navigational apparatus comprising a connection element, a movable horizontal drill assembly, and a movable vertical drill assembly, wherein the drill assemblies include independently actuated drills each having a fastening means preventing the navigational apparatus from slipping off the roof; a roof shingle removal apparatus configured to remove existing roof shingles, wherein the roof shingle removal apparatus is attached to the navigational apparatus via the connection element; and a roof shingle installation apparatus configured to install new roof shingles, wherein the roof shingle installation apparatus is attached to the navigational apparatus via the connection element.

In one embodiment, an auto-retractable lifeline safety harness is provided, wherein the harness is configured to attach to the navigational apparatus as a safety measure in case the navigational apparatus becomes detached from the roof unexpectedly. In one embodiment, roof shingle installation apparatus comprises a compartment configured to hold a bundle of shingles and a rotatable shingle peel member configured separate a single shingle from the bundle of shingles to rotate the single shingle 360 degrees. In one embodiment, the roof shingle installation apparatus further comprises a shingle position member, wherein the shingle position member is configured to travel along an x-axis and the rotatable shingle peel member is configured to travel along a y-axis. In another embodiment, the roof shingle installation apparatus further comprises at least one fastening member configured travel along a z-axis, wherein the at least one fastening member is configured to fasten the single shingle to the roof, and wherein the movement of the navigational apparatus and the at least one nailers enables precise locational control of fasteners corresponding to any shingle manufacturer installation specification and building code requirement.

One object of the present invention is to re-use the same navigation machinery for both roof removal and new shingle installation, allowing the operator to leverage the investment in the system for the entire roofing process.

Another object of the present invention is to work with multiple shingle manufacturer specifications, building codes, and existing packaging of material, requiring the system to flip shingles, cut the shingles to any length, and place nails in precise locations.

Yet another object of the present invention is to increase surface area coverage by removing and placing shingles up to the edge and peak of the roof.

One object of the present invention is to allow the operator to specify the location to dump the debris from the roof removal, allowing the operator to put all contents into a dumpster or debris slide avoiding plant destruction and manual cleanup.

Another object of the present invention is to enable the operator to safely control and monitor the system from a mobile device.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide an automatic roof shingle removal and installation system.

Figure 1:
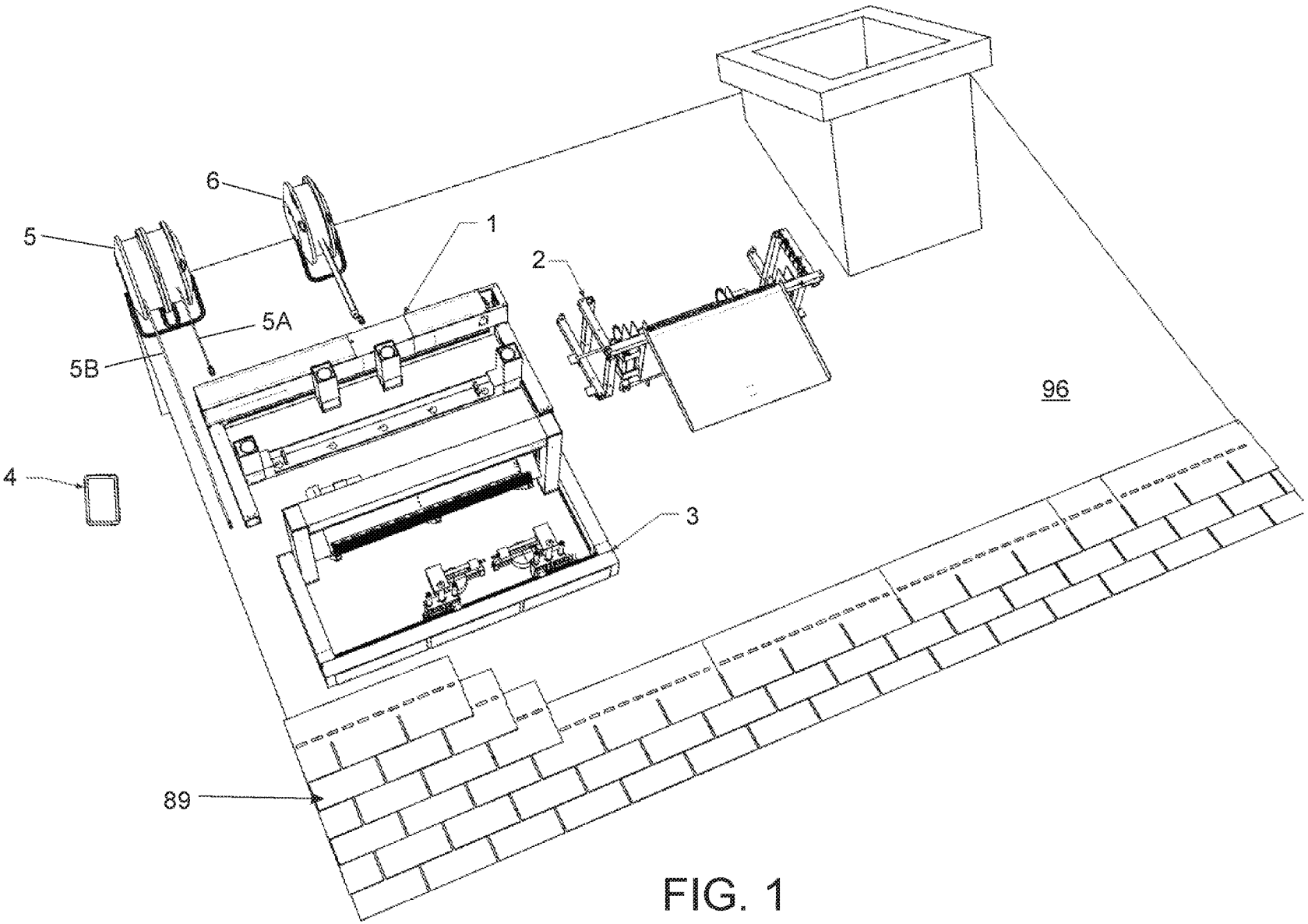
FIG. 1 is a perspective view of an automatic roof shingle removal and installation system on a roof according to an embodiment of the present invention.

FIG. 1 is a perspective view of an automatic roof shingle removal and installation system on a roof 96 according to an embodiment of the present invention. Referring now to FIG. 1, the system comprises a navigational apparatus 1, a roof shingle removal apparatus 2, and a roof shingle installation apparatus 3. The navigational apparatus is configured to traverse the roof moving either an attached roof shingle removal or installation apparatus into position. In one embodiment, the navigational apparatus is controlled and monitored with a mobile device 4. The system further comprises an auto-retractable reel 5 having an electric supply cord 5A and a pneumatic hose 5B. In one embodiment, an auto-retractable lifeline safety harness 6 is provided, wherein the harness is configured to attach to the navigational apparatus as a safety measure, in case the device and attached apparatus becomes detached from the roof unexpectedly. The components of each apparatus and the operation of the system will be described in further detail.

FIGS. 2A-D are various views of a navigational apparatus 1 of the automatic roof shingle removal and installation system according to an embodiment of the present invention. Referring now to FIGS. 2A-D, the navigational apparatus is illustrated. In one embodiment, the navigational apparatus comprises a rectangular structural body 1A having a horizontal body member 1B attached parallel to the underside of the structural body, and a pair of vertical body members 1C attached perpendicular at opposite ends of the horizontal body member as illustrated. The navigational apparatus further comprises a plurality of fans 7, a safety harness attachment bracket 8, an emergency stop button 9, electrical communication connector 10, and an electric power connection 11 all located in the rectangular structural body. The safety harness attachment bracket is configured to hold the harness of the auto-retractable lifeline safety harness shown in FIG. 1. The electrical communication connection is configured to accept either the roof shingle removal or installation apparatus when attached to the navigational apparatus.

In one embodiment, the horizontal body member includes a first slot 17A running the length of the horizontal body member, wherein the first slot allows a horizontal drill assembly 12 to travel along a first threaded rod 17. Likewise, in one embodiment, each of the pair of vertical body members include a second slot 16A running the length of each of the pair of vertical body members, wherein the second slot allows a vertical drill assembly 13 to travel along a second threaded rod 16.

Figure 2A:
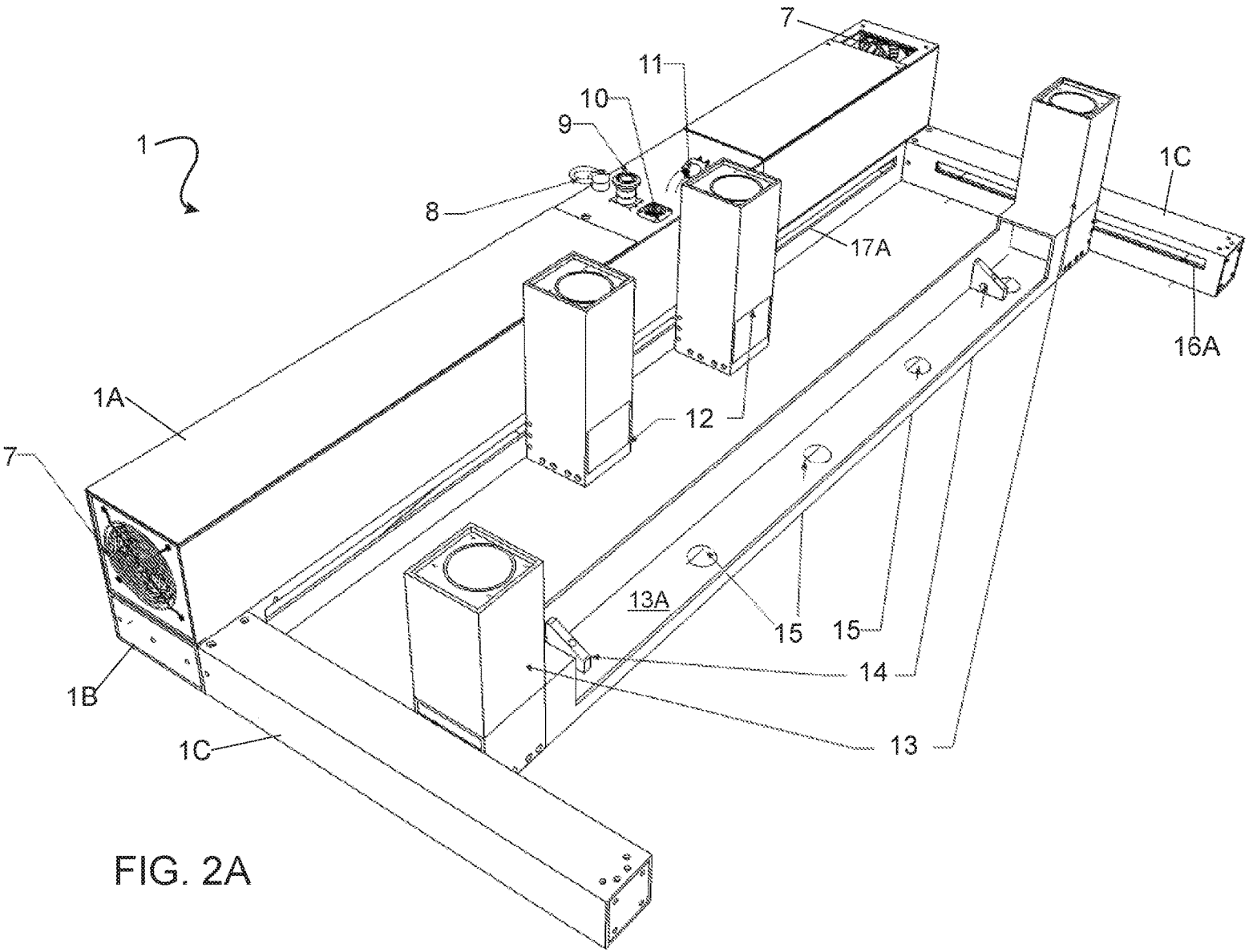
FIG. 2A is a top perspective view of a navigational apparatus of the automatic roof shingle removal and installation system according to an embodiment of the present invention.
Figure 2B:
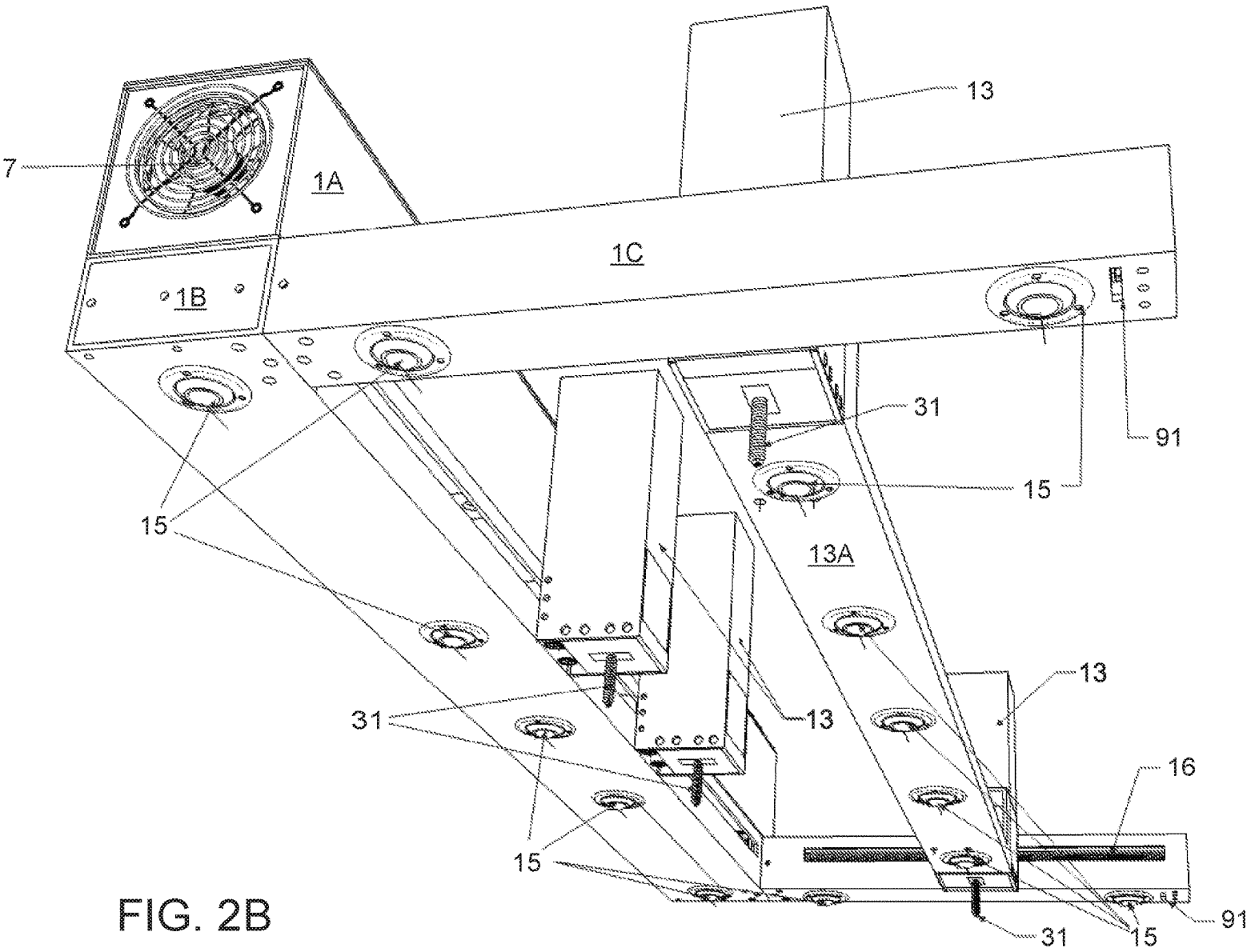
FIG. 2B is a bottom perspective view of the navigational apparatus of the automatic roof shingle removal and installation system according to an embodiment of the present invention.
Figure 2C:
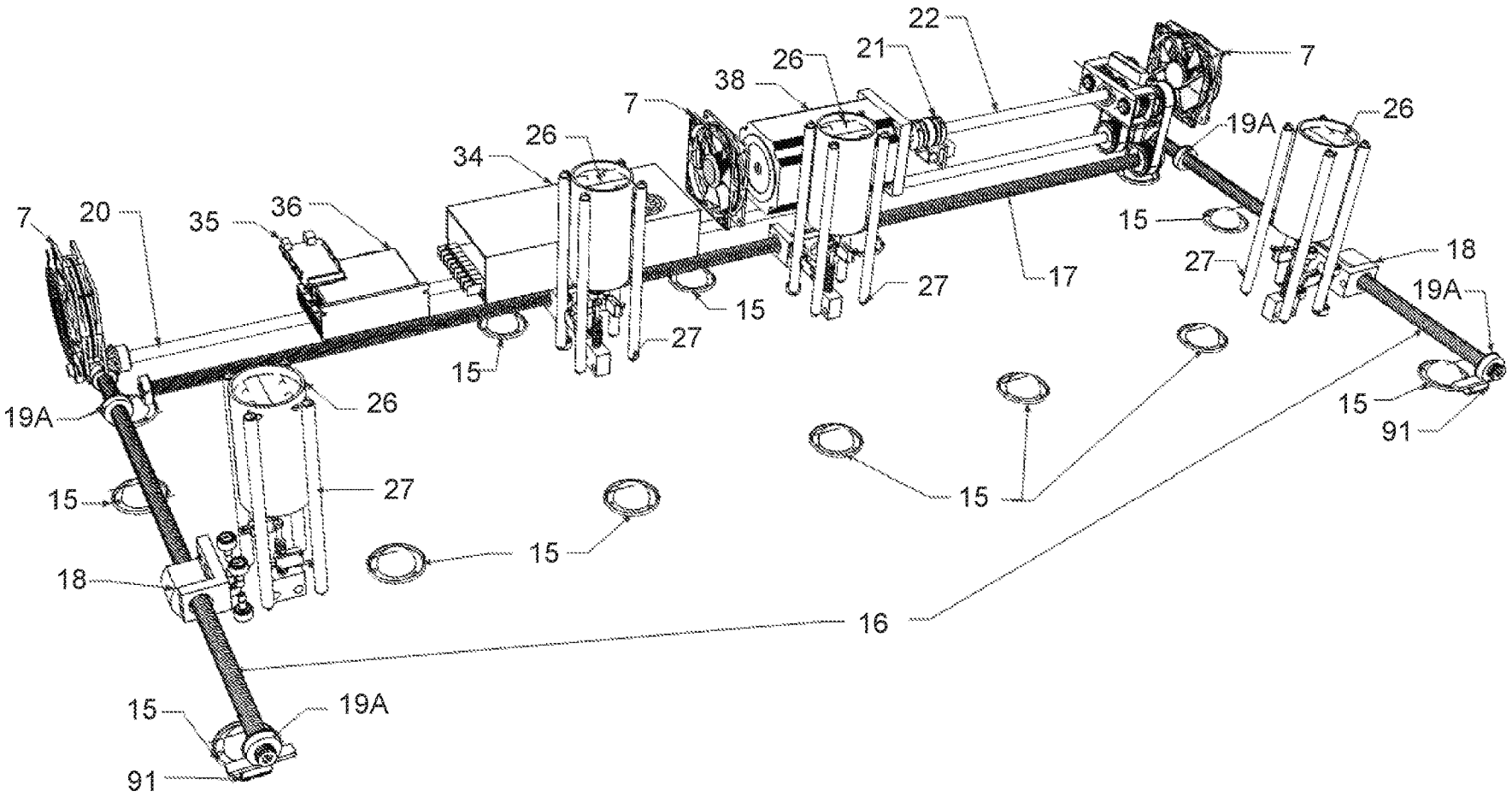
FIG. 2C is a top perspective view of the navigational apparatus of the automatic roof shingle removal and installation system with the structural body removed according to an embodiment of the present invention.
Figure 2D:
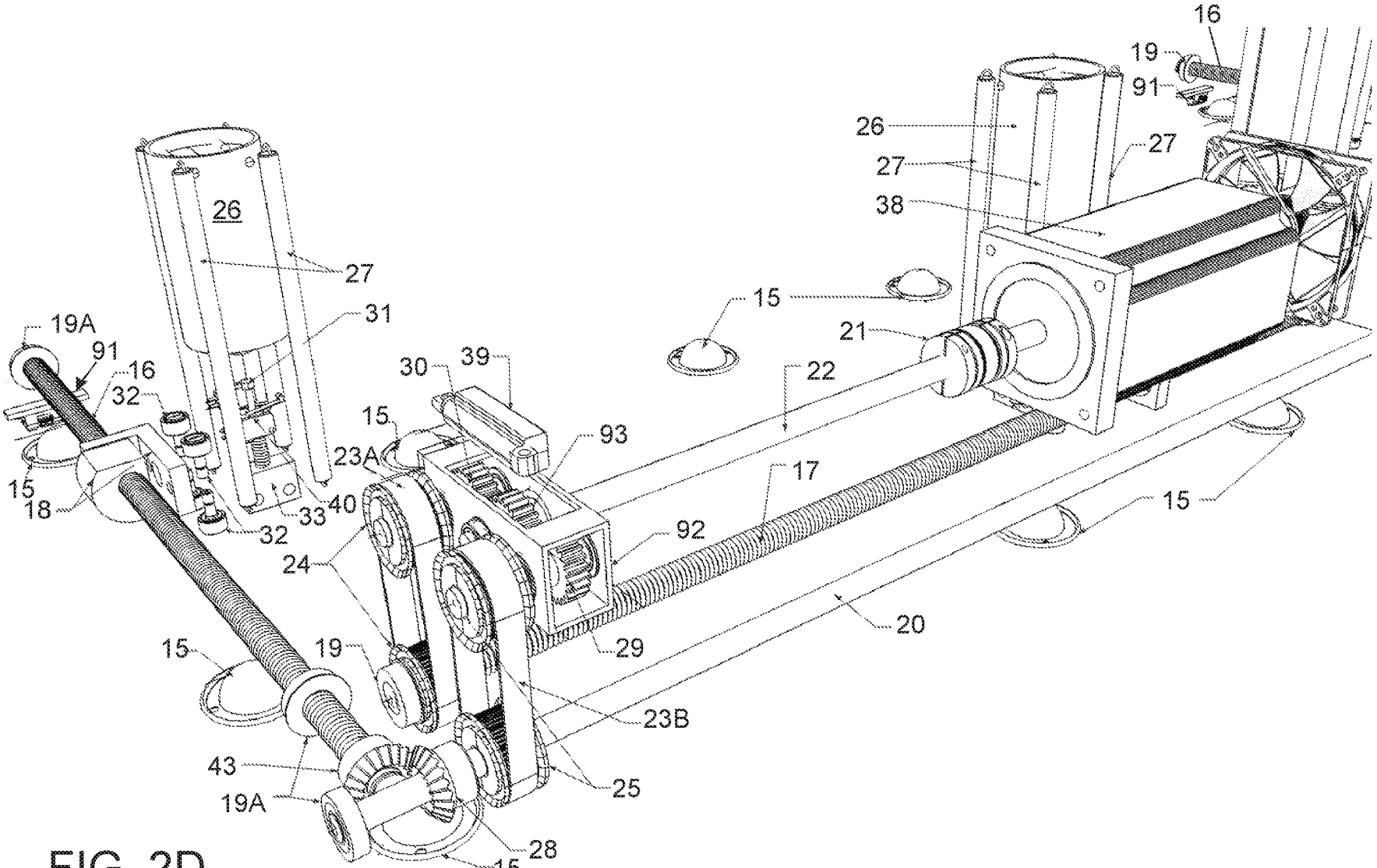
FIG. 2D is a detailed view of the navigational apparatus of the automatic roof shingle removal and installation system with the structural body removed according to an embodiment of the present invention.

In operation, best seen in FIG. 2D, a motor 38 controlled by motor controller 36 rotates shaft 22 via coupling member 21, which then rotates motor gear 93. Next, a liner actuator 39 is configured to move a transmission bracket 92 either to engage a vertical gear 29 or a horizontal gear 30 depending on if the vertical or horizontal drill assembly is desired to be moved. More specifically, if the vertical drill assembly is desired to be moved, the transmission bracket engages the vertical gear, such that second timing belt pulleys 25 and a second timing belt 23B rotate via the vertical gear, which then rotates rod 20. In one embodiment, a miter gear 28 transfers the rotation of the rod to the second threaded rod, which rotates on bearings 19A. Similarly, if the horizontal drill assembly is desired to be moved, the transmission bracket engages the horizontal gear, such that first timing belt pulleys 24 and a first timing belt 23A rotate via horizontal gear, which then rotates the first threaded rod on bearings 19. Each drill assembly rolls on a body member via needle bearings 32 attached to mounting bracket lead screw combination members 18. For instance, the pair of vertical drill assembles roll on the pair of vertical body members, and the horizontal drill assembly rolls on the horizontal body member.

In one embodiment, each drill assembly comprises at least one drill 26 having a plurality of tension springs 27, wherein the plurality of tension springs force the drill towards the roof during operation. The at least one drill also comprises a threaded plate 33 for receiving a lag screw 31. It is a particular advantage of the present invention, that the lag screws are configured to be fastened into the roof deck preventing the navigation apparatus from slipping off the incline of the roof. The threaded plate allows the lag screw to rotate up or down preventing the plurality of tension springs from constantly applying pressure into roof, and specifically the roof sheathing. In one embodiment, limit switches 40 are provided to stop further drilling when the lag screw is already fastened into the roof deck.

As previously mentioned, the navigational apparatus is configured accept the roof shingle removal or installation apparatus during use. Either apparatus is attached via connection mounting bracket 14 located on a bridge member 13A, which is part of the structural body between each drill of the vertical drill. A plurality of wheels 15 are position on the underside of the bridge member, the horizontal body member, and the pair of vertical body members. The position of the plurality of wheels enables the navigational apparatus to overhang the edge of the roof allowing the removal and installation of shingles on the edge of the roof. In one embodiment, the navigational apparatus includes proximity sensors 91 located at the distal ends of the pair of vertical body members, wherein the proximity sensors detect the edges of the roof.

In one embodiment, a power supply 34 is provided to convert the supplied AC power to DC power as well known in the art. In one embodiment, an integrated circuit 35 is provided, wherein the integrated circuit includes several electronical components including but not limited to a microcontroller, a gyroscope, a wireless communication means, and an accelerometer. It is a particular advantage of the present invention that the navigational apparatus includes auto-leveling capabilities ensuring the navigational apparatus travels in straight lines. For instance, the angle of the navigational apparatus is detected via the gyroscope, wherein the microcontroller can fasten one of the independently actuated vertical drill assemblies, and push the navigational apparatus back into a level horizontal position utilizing the second threaded rod.

Figure 3:
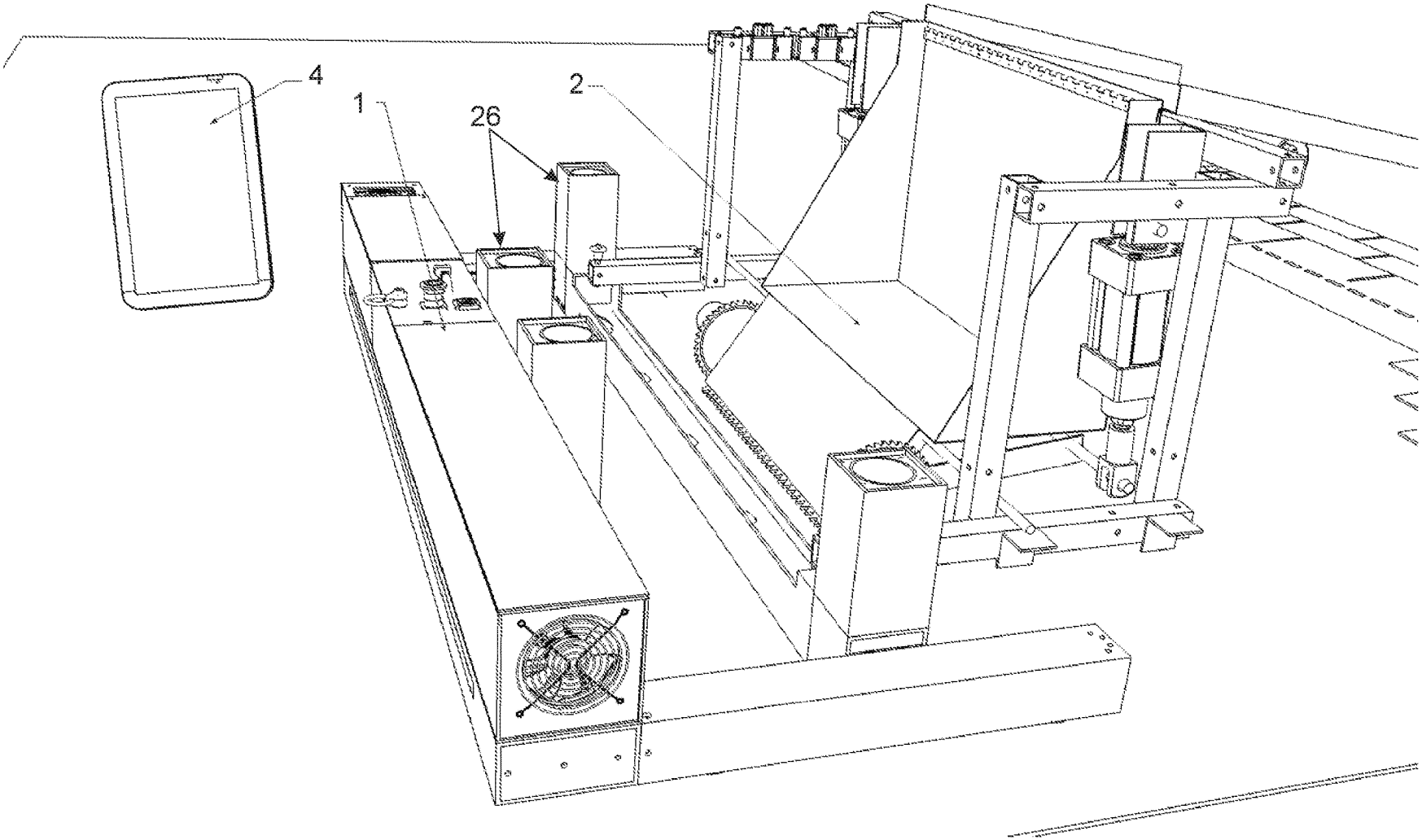
FIG. 3 is a perspective view of a roof shingle removal apparatus mounted to the navigational apparatus according to an embodiment of the present invention.
Figure 4:
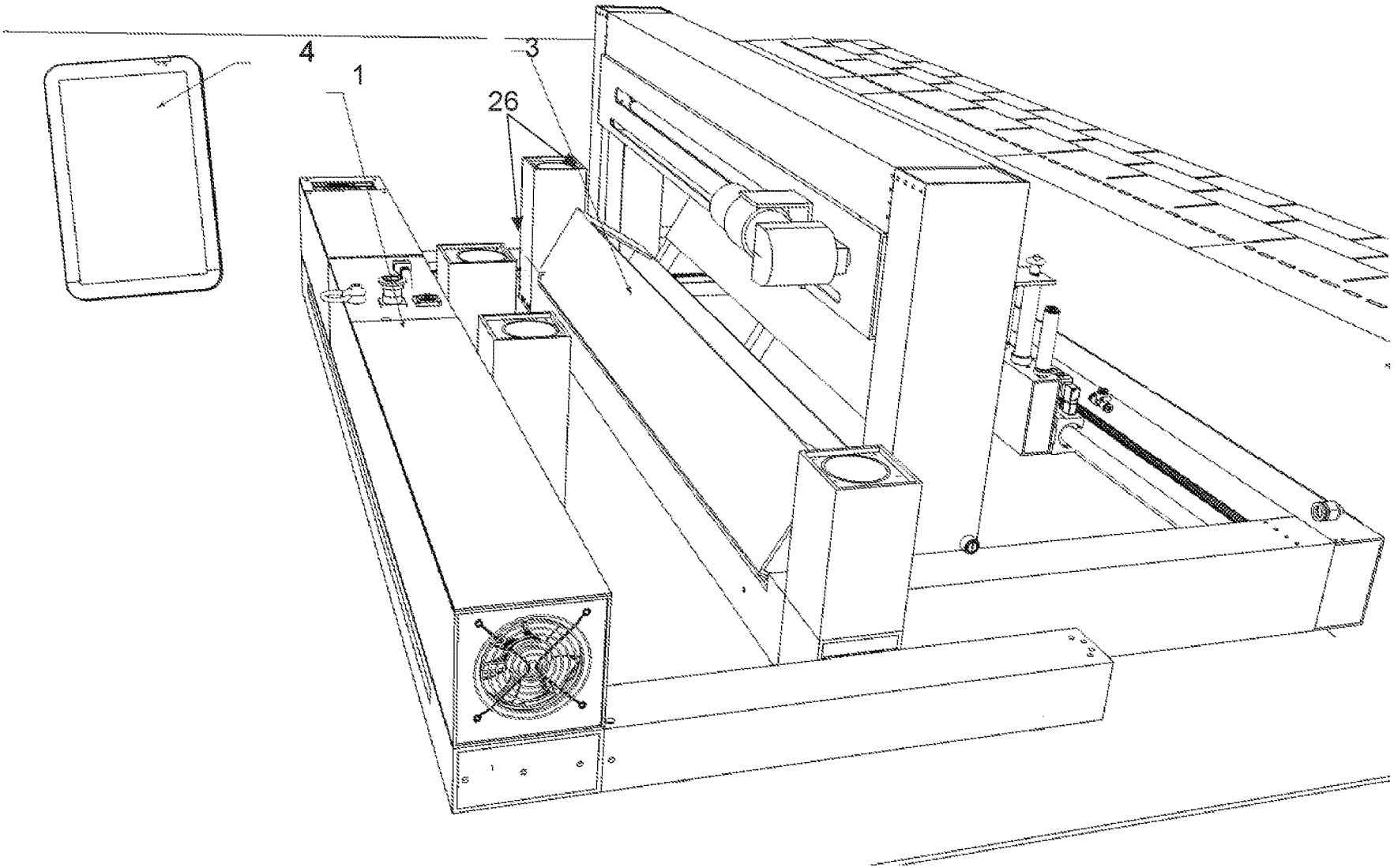
FIG. 4 is a perspective view of a roof shingle installation apparatus mounted to the navigational apparatus according to an embodiment of the present invention.
Figure 5A:
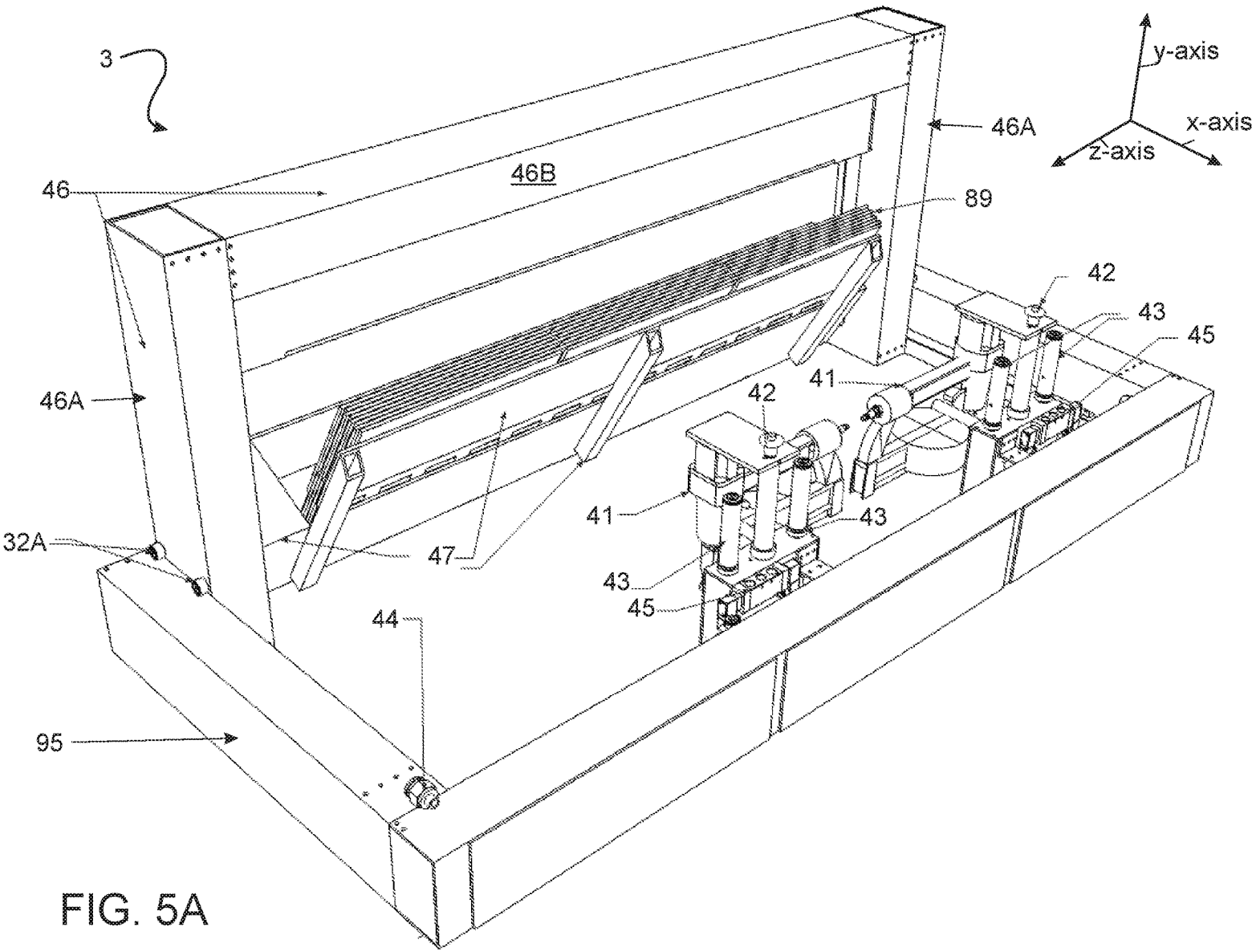
FIG. 5A is a top perspective view of a roof shingle installation apparatus according to an embodiment of the present invention.
Figure 5B:
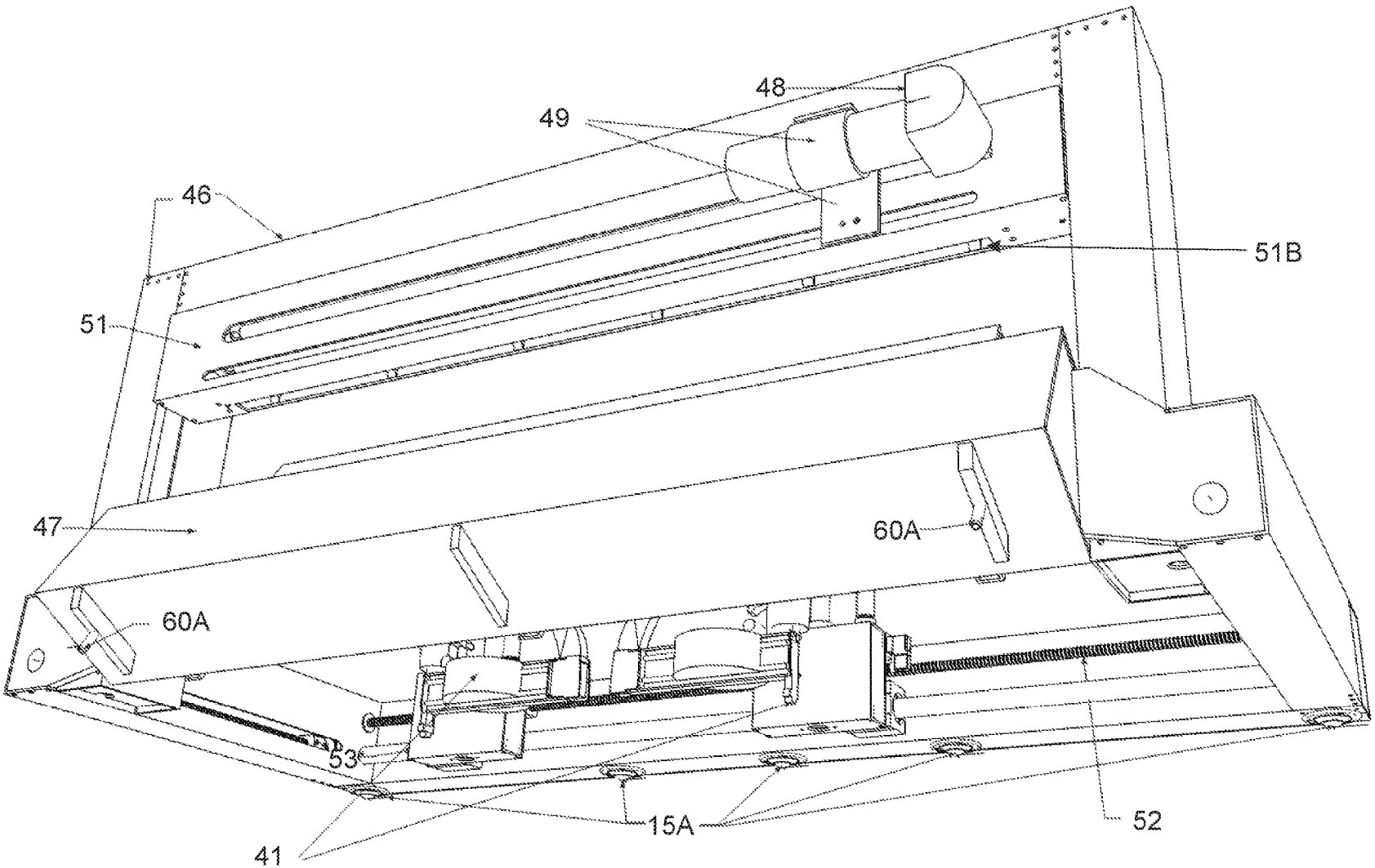
FIG. 5B is a bottom perspective view of the roof shingle installation apparatus according to an embodiment of the present invention.
Figure 5C:
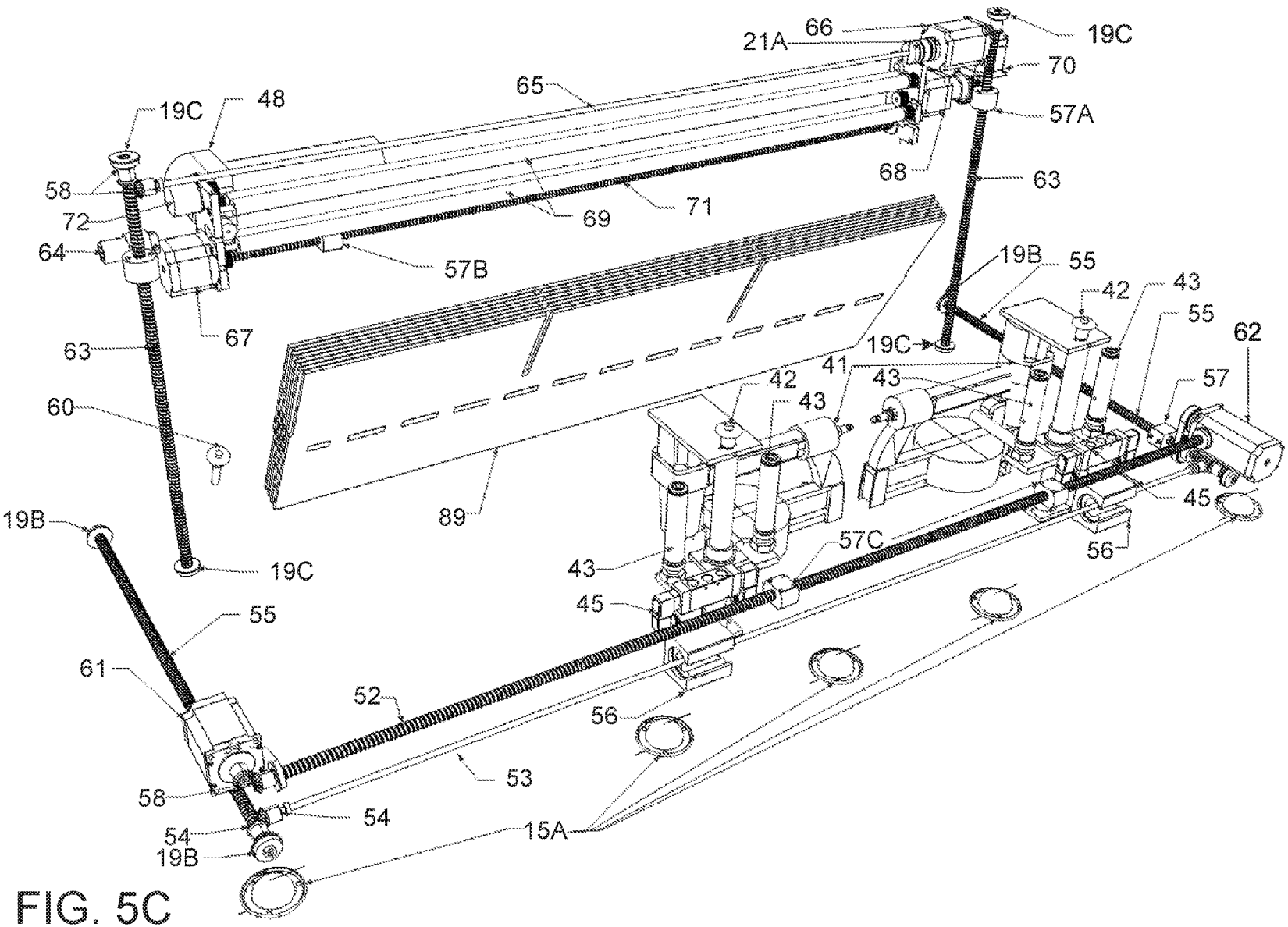
FIG. 5C is a top perspective view of the roof shingle installation apparatus with the structural body removed according to an embodiment of the present invention.
Figure 5D:
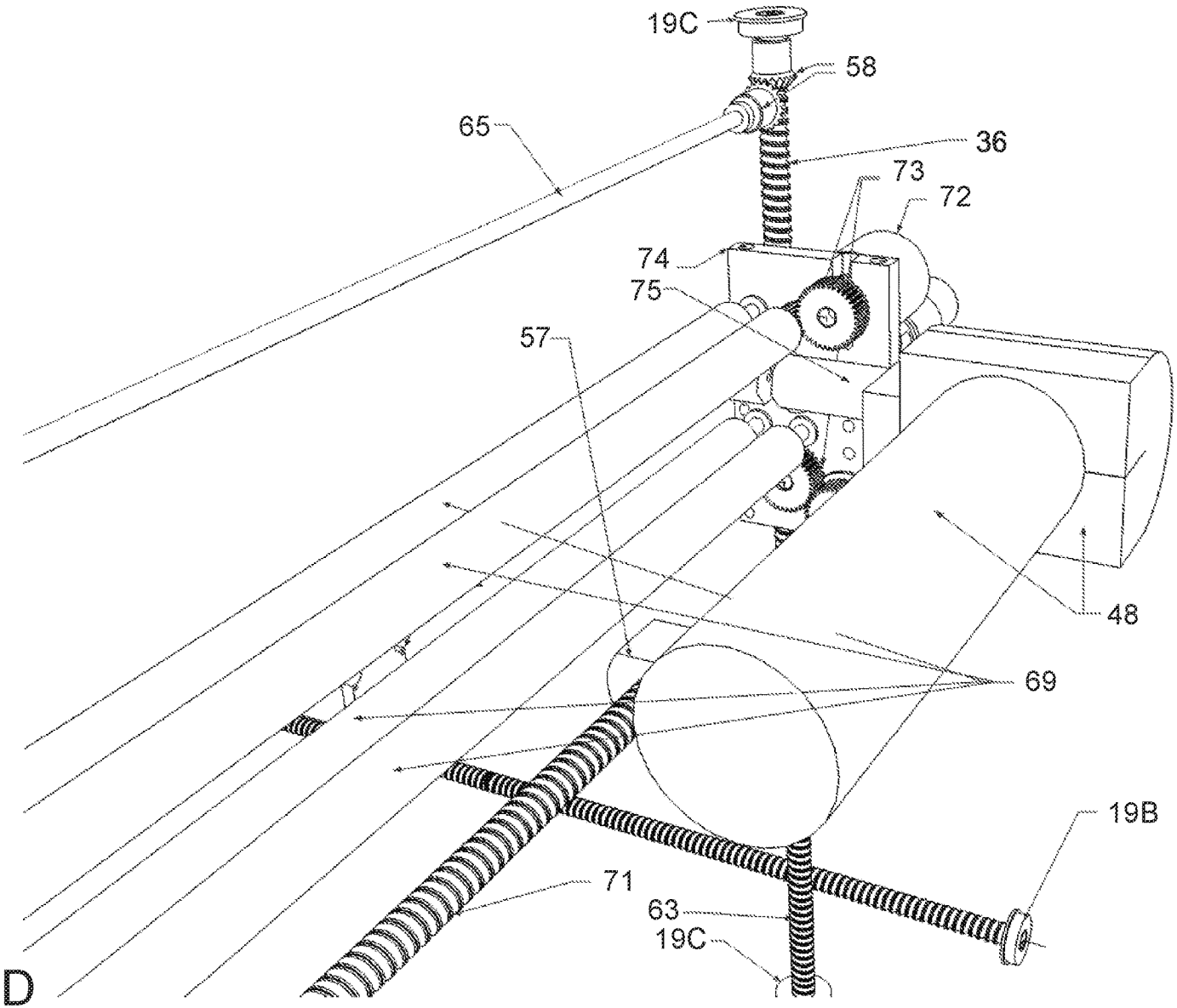
FIG. 5D is a detailed view of a cutting device of the roof shingle installation apparatus with the structural body removed according to an embodiment of the present invention.
Figure 5E:
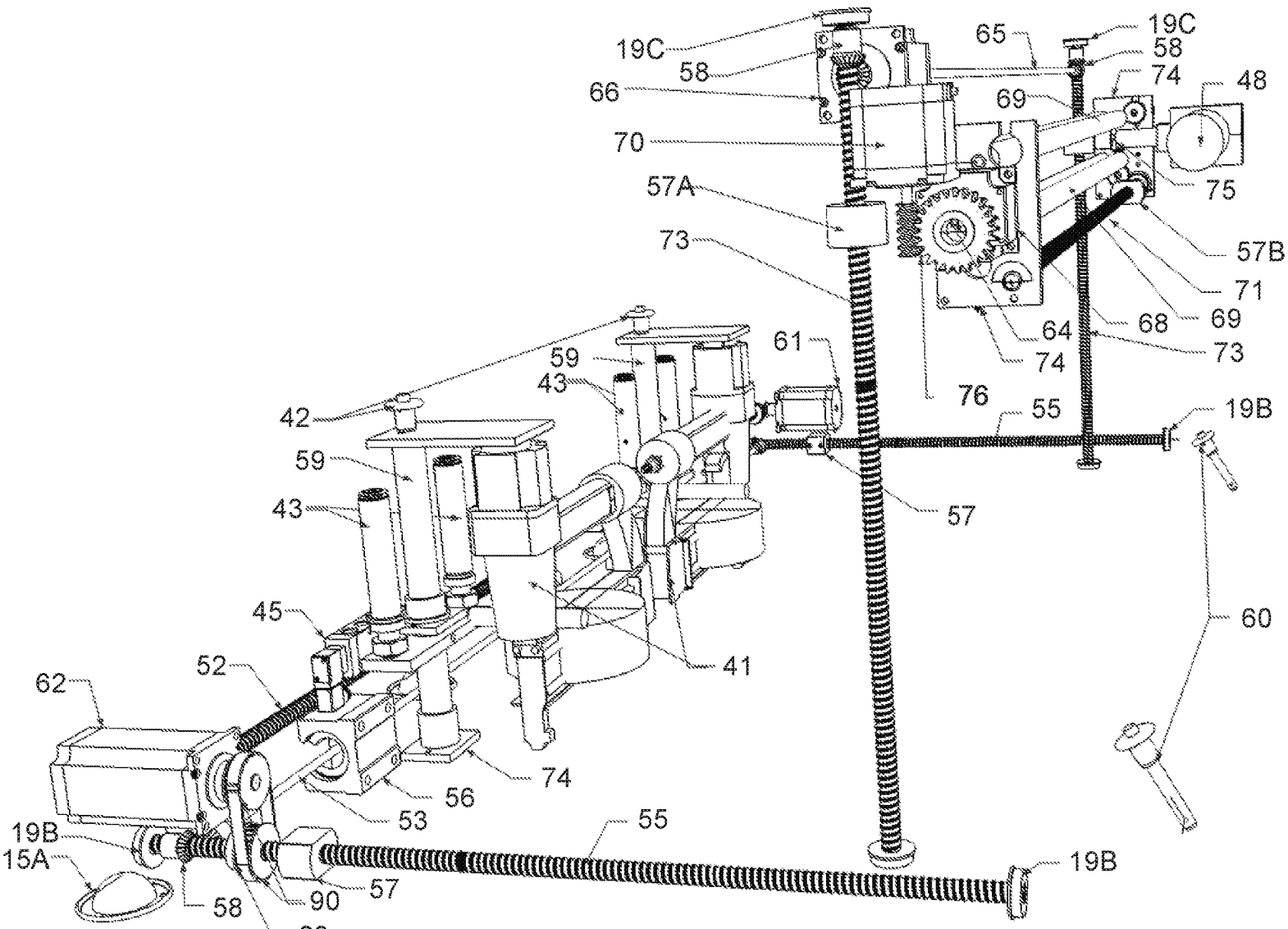
FIG. 5E is a side perspective view of the roof shingle installation apparatus with the structural body removed according to an embodiment of the present invention.

FIGS. 3 and 4 are perspective views of a roof shingle removal apparatus 2 and a roof shingle installation apparatus 3 mounted to the navigational apparatus respectively according to an embodiment of the present invention. The roof shingle removal and installation apparatus will be discussed in further detail below. It is a particular advantage of the present invention, that when the roof shingle installation apparatus is mounted to the navigational apparatus drill assemblies 26 are always orientated above the roof shingle installation apparatus ensuring drill shoes are not screwed into the new shingles as shingles are being installed on the roof.

FIGS. 5A-E are various perspective views of a roof shingle installation apparatus 3 according to an embodiment of the present invention. Referring now to FIGS. 5A-E, the roof shingle installation apparatus is illustrated. The roof shingle installation apparatus includes quick release cotter pins 60A to attach the roof shingle installation apparatus to the navigational apparatus. In one embodiment, the quick release cotter pins are proximally located to the point of attachment, i.e. connection mounting bracket 14 located on bridge member 13A (FIG. 2A). The plurality of wheels on the bridge member as well as wheels 15A allows the combination of apparatuses to roll along the roof.

The roof shingle installation apparatus comprises a shingle position bar 46 consisting of a pair of vertical body members 46A and a horizontal body member 46B. The shingle position bar rolls along a structural body 95 via needle bearing wheels 32A. Specifically, the shingle position bar is attached to lead screws 57 that travel along threaded rods 55 which rotate on bearings 19B. In one embodiment, the linear motion of the shingle position bar is powered by motor 62, and the power is transferred to each threaded rod via shingle position bar rod 53 and miter gears 54. The linear motion is a horizontal motion along an x-axis corresponding to the structural body.

Figure 8A:
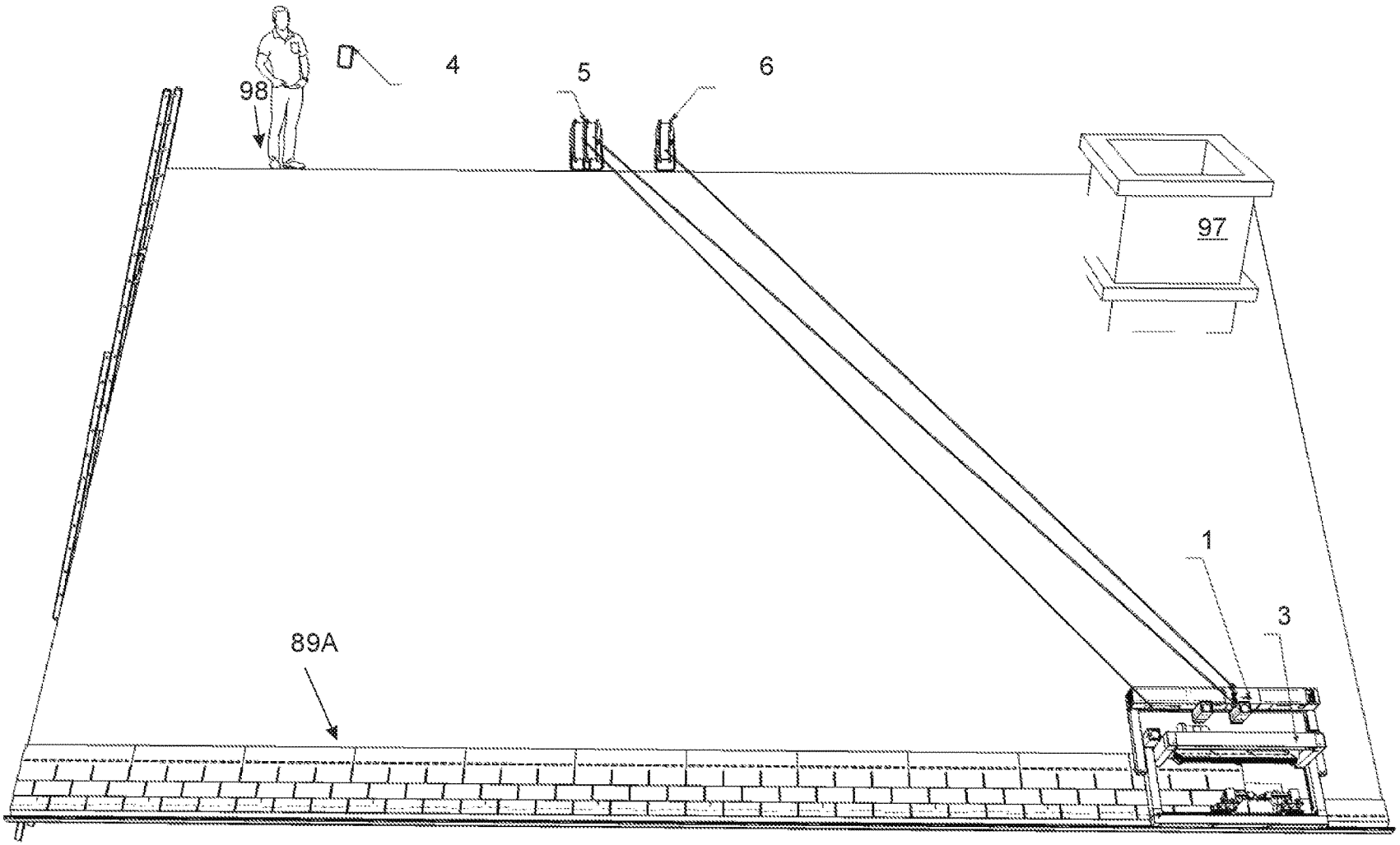
FIG. 8A illustrates the installation of new shingles using the system according to an embodiment of the present invention.
Figure 8B:
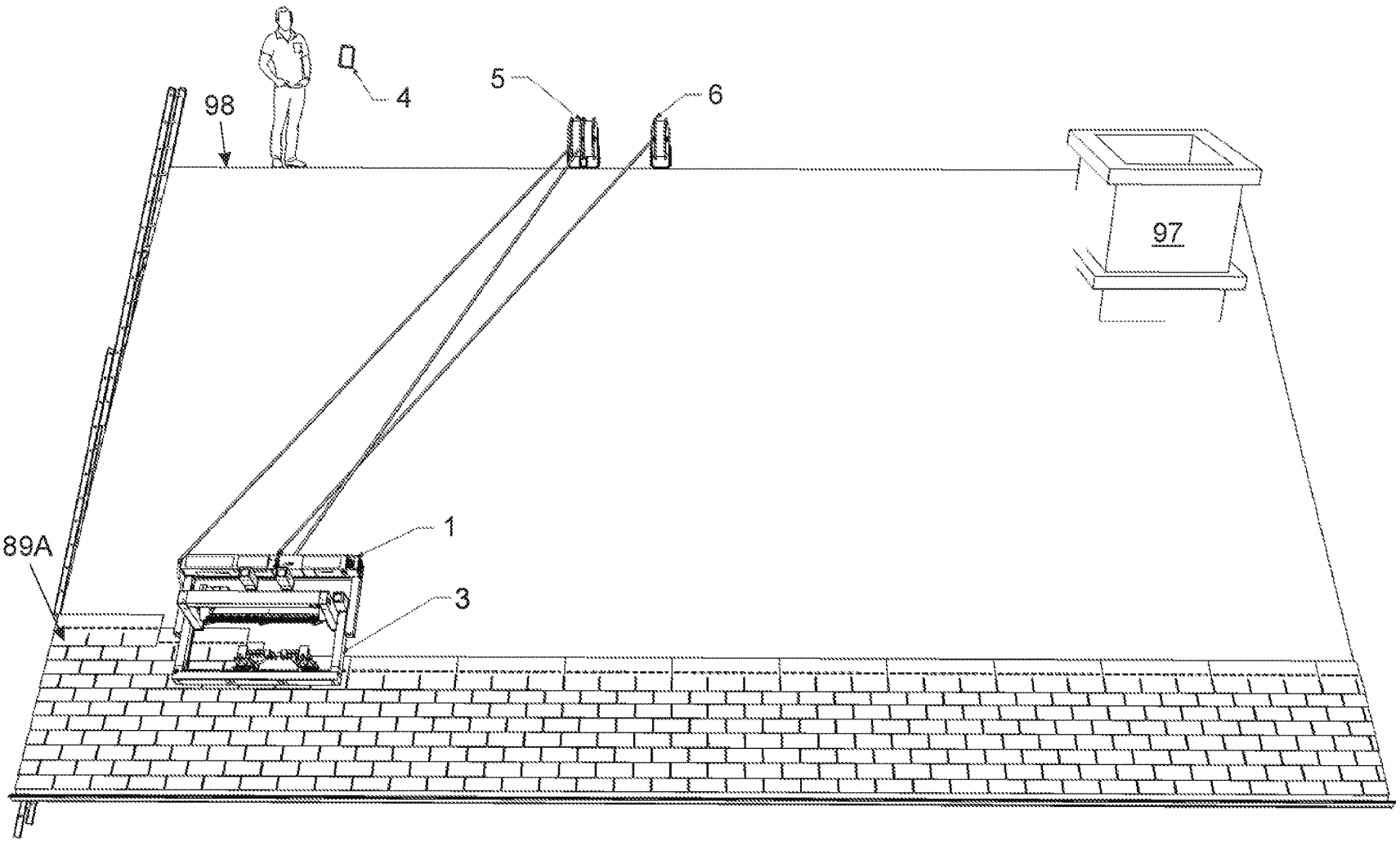
FIG. 8B illustrates the installation of new shingles using the system according to an embodiment of the present invention.
Figure 8C:
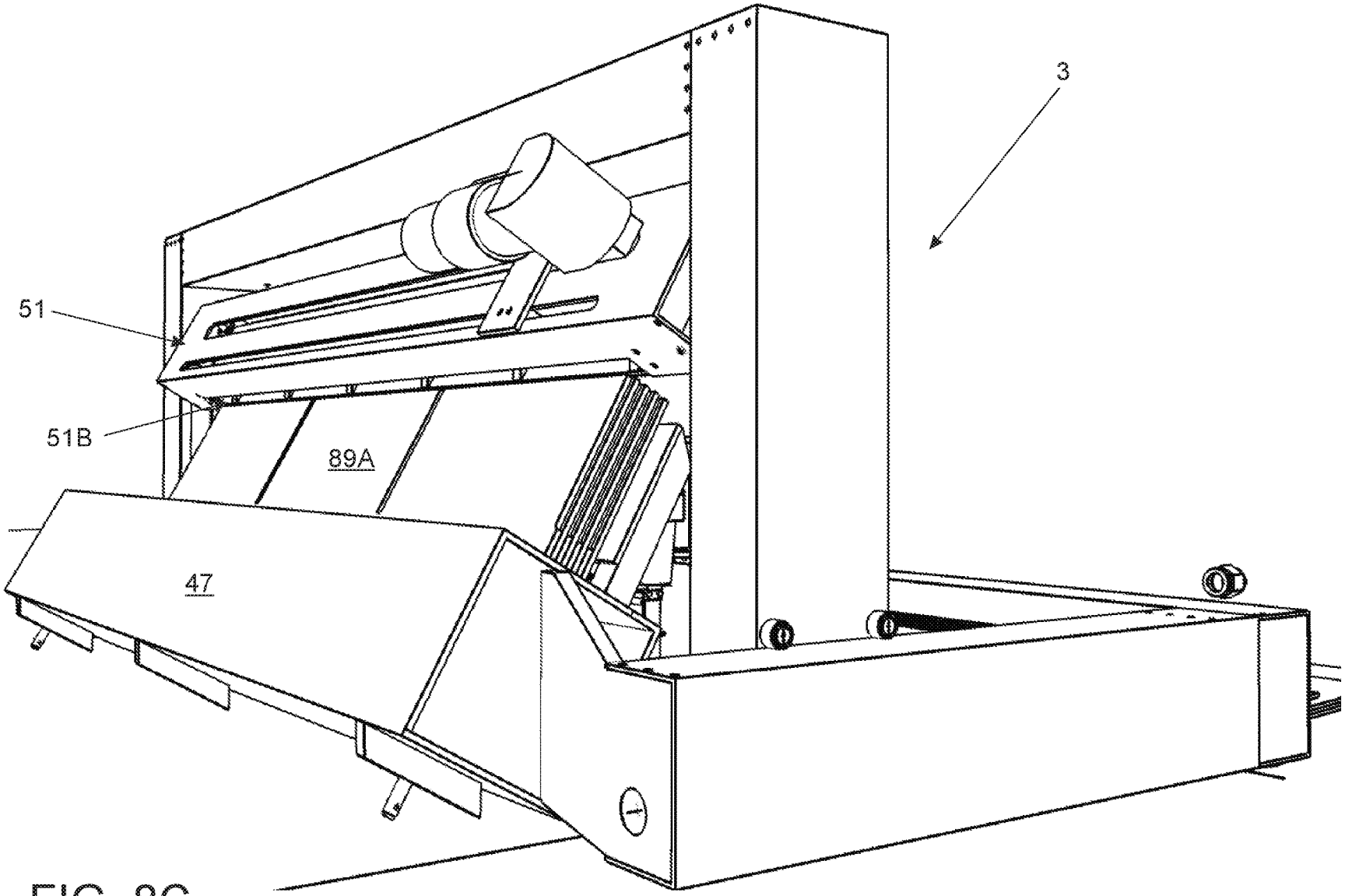
FIG. 8C is a detailed view of the roof installation shingle apparatus as it moves the shingle peel bar into position according to an embodiment of the present invention.
Figure 8D:
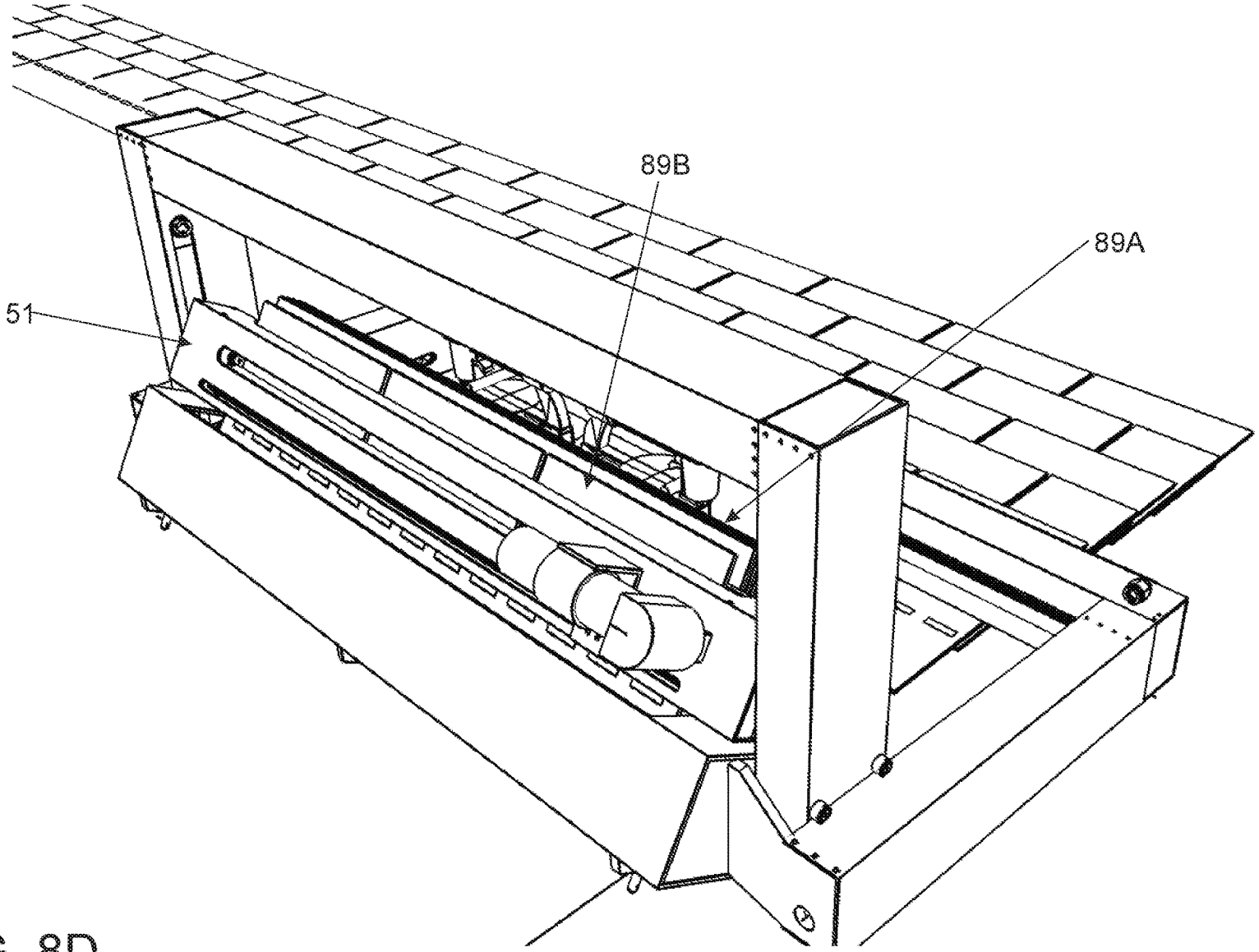
FIG. 8D is a detailed view of the roof installation shingle apparatus as it separates a single shingle from the bundle of shingles according to an embodiment of the present invention.
Figure 8E:
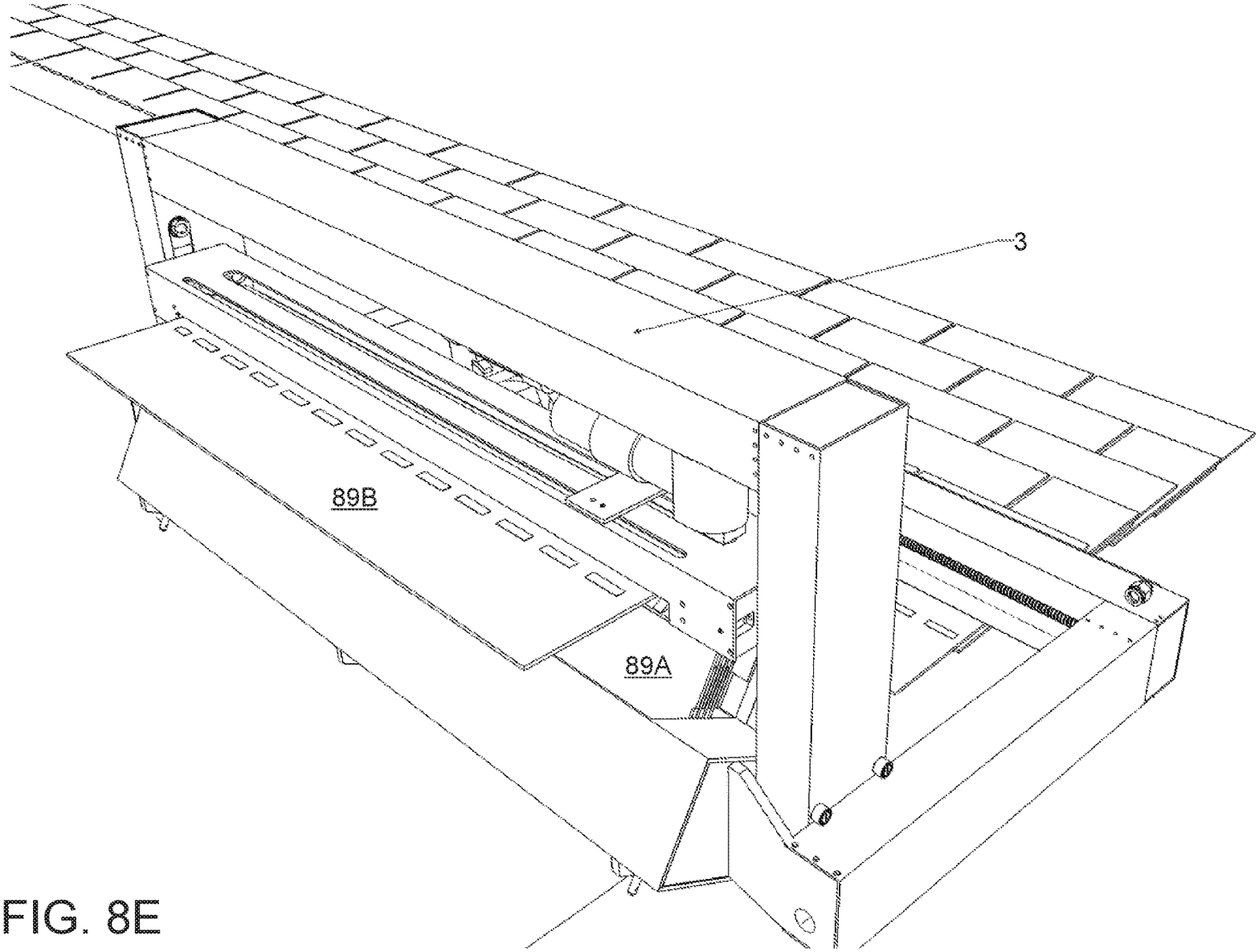
FIG. 8E is a detailed view of the roof installation shingle apparatus as it lifts the single shingle off the bundle of shingles according to an embodiment of the present invention.
Figure 8F:
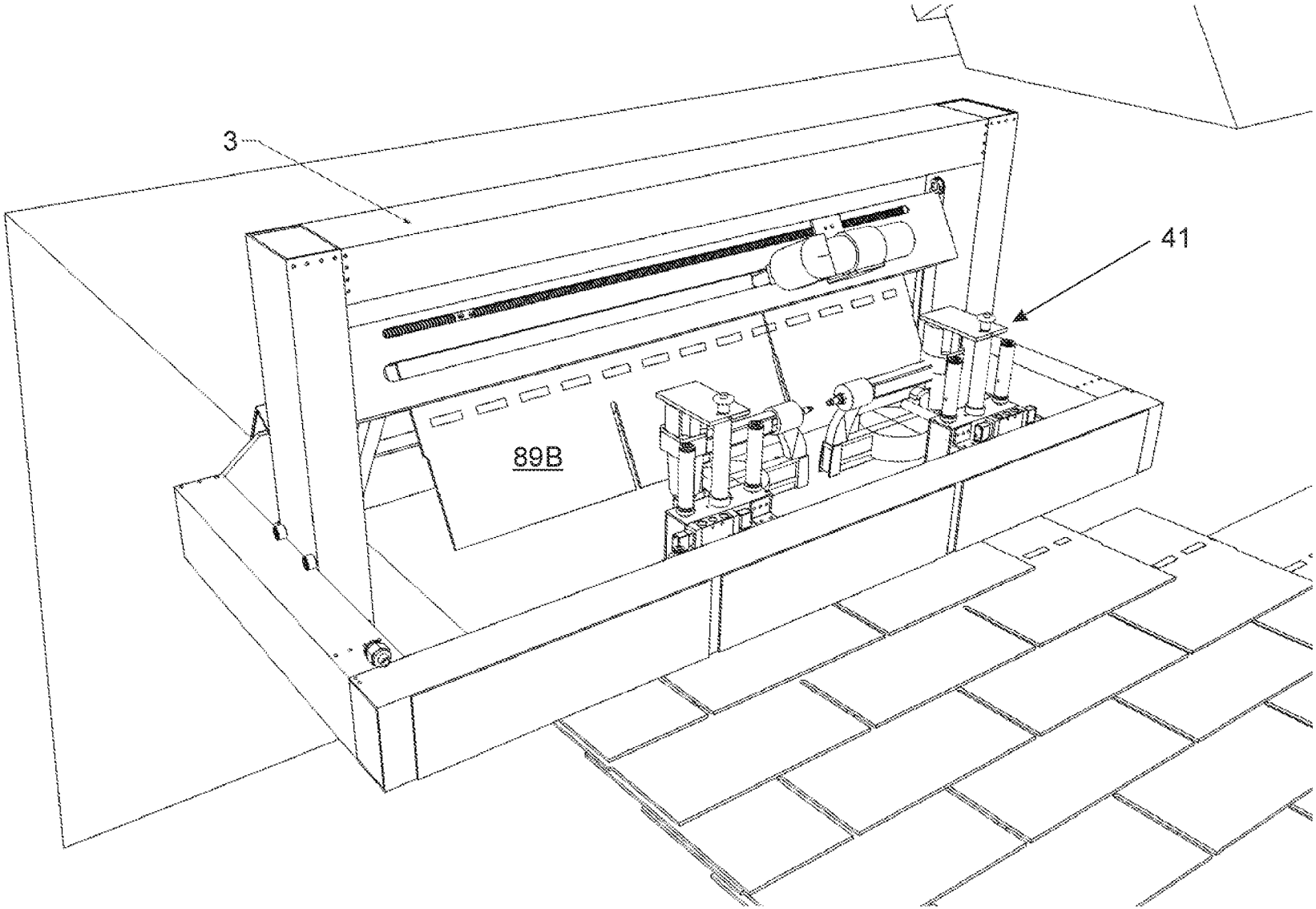
FIG. 8F is a detailed view of the roof installation shingle apparatus as it cuts the single shingle to a size required by the shingle manufacture for staggering seams according to an embodiment of the present invention.
Figure 8G:
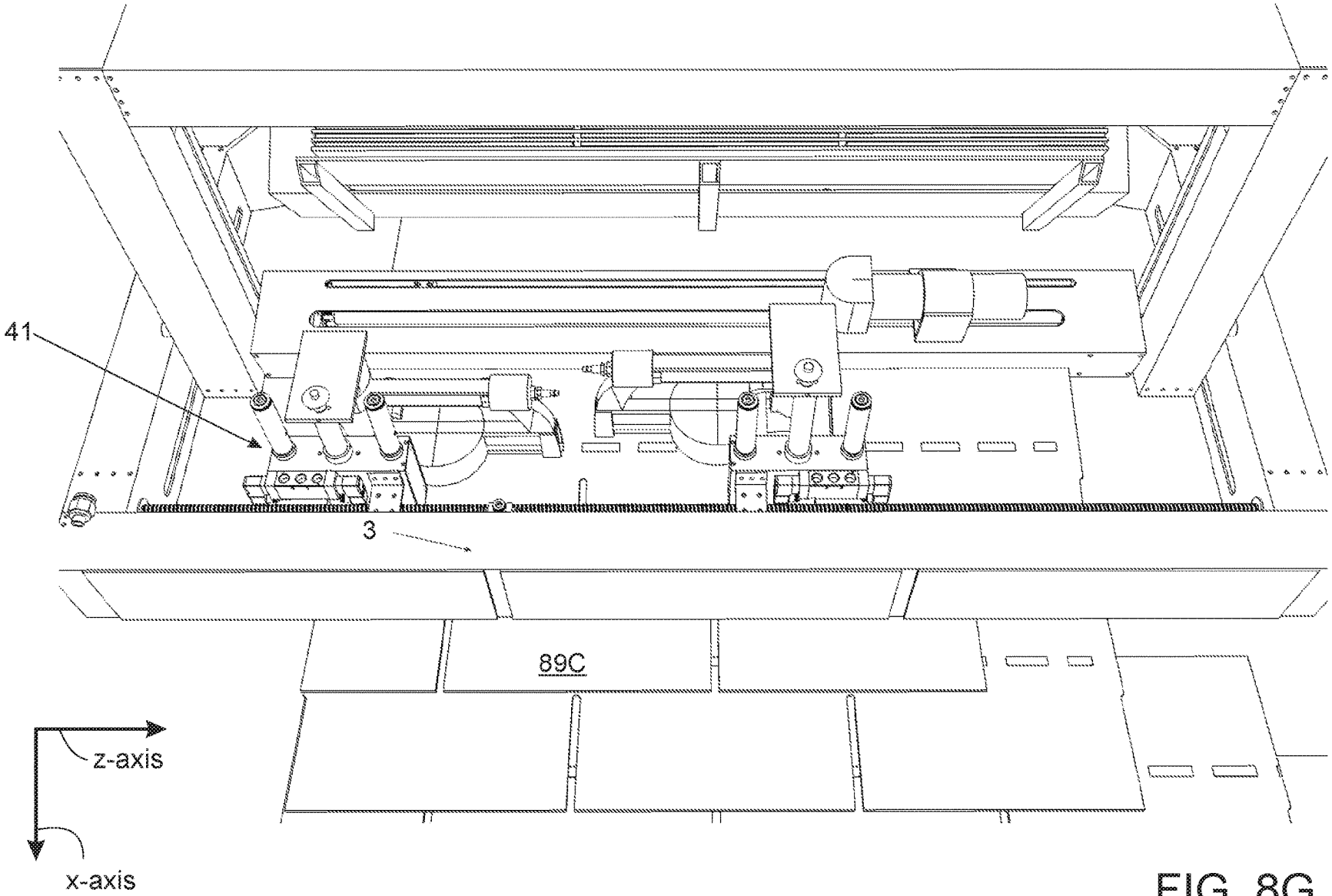
FIG. 8G is a detailed view of the roof installation shingle apparatus as it fastens the single shingle to the roof sheathing of a home according to an embodiment of the present invention.

In one embodiment, the roof shingle installation apparatus further comprises a shingle peel bar 51 that is configured to be moved vertically along a y-axis corresponding to the pair of vertical body members. The shingle peel bar is attached to lead screws 57A which travel along vertical threaded rods 63, which are rotated on bearings 19C. In one embodiment, the vertical motion is powered by motor 66 coupled to shaft 65 via coupler 21A, and transferred to both vertical threaded rods 63 with miter gear 58. It is a particular advantage of the present invention, that the shingle peel bar is configured to rotate 360 degrees around axis 64 via motor 70 which actuates worm gear 76. This rotation is critical as the 360 degree rotation is used to flip shingles to face opposite directions. Since it is well known in the art, that roof material manufacturers package shingle bundles with every other shingle facing a different direction to prevent applied tar from sticking together and ruining the shingles. In one embodiment, a mounting bracket 74 is provided to attach the shingle peel bar axis, wherein the mounting bracket is configured to hold a plurality of rollers 69. A separating edge 51B provided on the bottom side of the shingle peel bar, separates a shingle from the bundle of shingles 89 (best seen in FIGS. 8C-D), wherein the plurality of rollers pushes and pulls the shingle through the shingle peel bar (best seen in FIGS. 8E-F). In one embodiment, a motor 68 powers the rotation of the plurality of shingles. In one embodiment, a rotary encoder 72 is provided, wherein the rotary encoder is configured to detect the location of the shingle via gear 73. In one embodiment, the mounting bracket also holds a horizontal threaded rod 71, wherein a cutting device 48 mounted to cutting device bracket 49 moves along the horizontal threaded rod in a similar fashion as the previously mentioned components that travel along threaded rods. Specifically, a provided lead screw 57B is attached to the cutting device bracket which travels along the threaded rod to move the cutting device along the shingle peel bar, wherein the rotation of the horizontal threaded rod and lead screw travel is operated by cutting device motor 67.

In one embodiment, the cutting device is a nibbler as well known in the art, wherein the nibbler is used to precisely cut shingles. It is a particular advantage of the present invention, that the cutting device can cut a shingle at any length or any angle by precisely moving the cutting device along axis 64 while the shingle is moved through via rollers 69 at a different axis. For instance, angle cut shingles are needed for valleys as well known in the art. Likewise, shingle manufacture installation guides require different lengths to be cut to stagger the seams of the roof, as well known in the art.

During operation, the shingle peel bar is configured to pick up, flip, and move a single shingle from the bundle of shingles into position for fastening on the roof. In one embodiment, the bundle of shingles is held in tray 47. Each new shingle is fastened to the roof via pneumatic nailer guns 41. In one embodiment, two independently actuated pneumatic nailer guns are provided. Each pneumatic nailer gun comprises air cylinders 43 and a solenoid 45 configured to actuate the air cylinders to move the nailer down to the roof deck during operation. An air hose connector 44 provided on the apparatus is configured to be attached to the pneumatic hose (5B; FIG. 1). In one embodiment, each pneumatic nailer gun includes a quick release pin 42 allowing a user to detach the nailer from the apparatus such that nails can be loaded as well known in the art. In one embodiment, the pneumatic nailer guns travel along threaded rod 52 in line with a z-axis via attached lead screws 57C, enabling the nailers to be positioned in the precise location in accordance by the specific shingle manufacture's installation guide. In one embodiment, motor 61 powers and rotates threaded rod 52. In one embodiment, linear bearings 56 are provided to add stability to the pneumatic nailer guns.

Figure 6A:
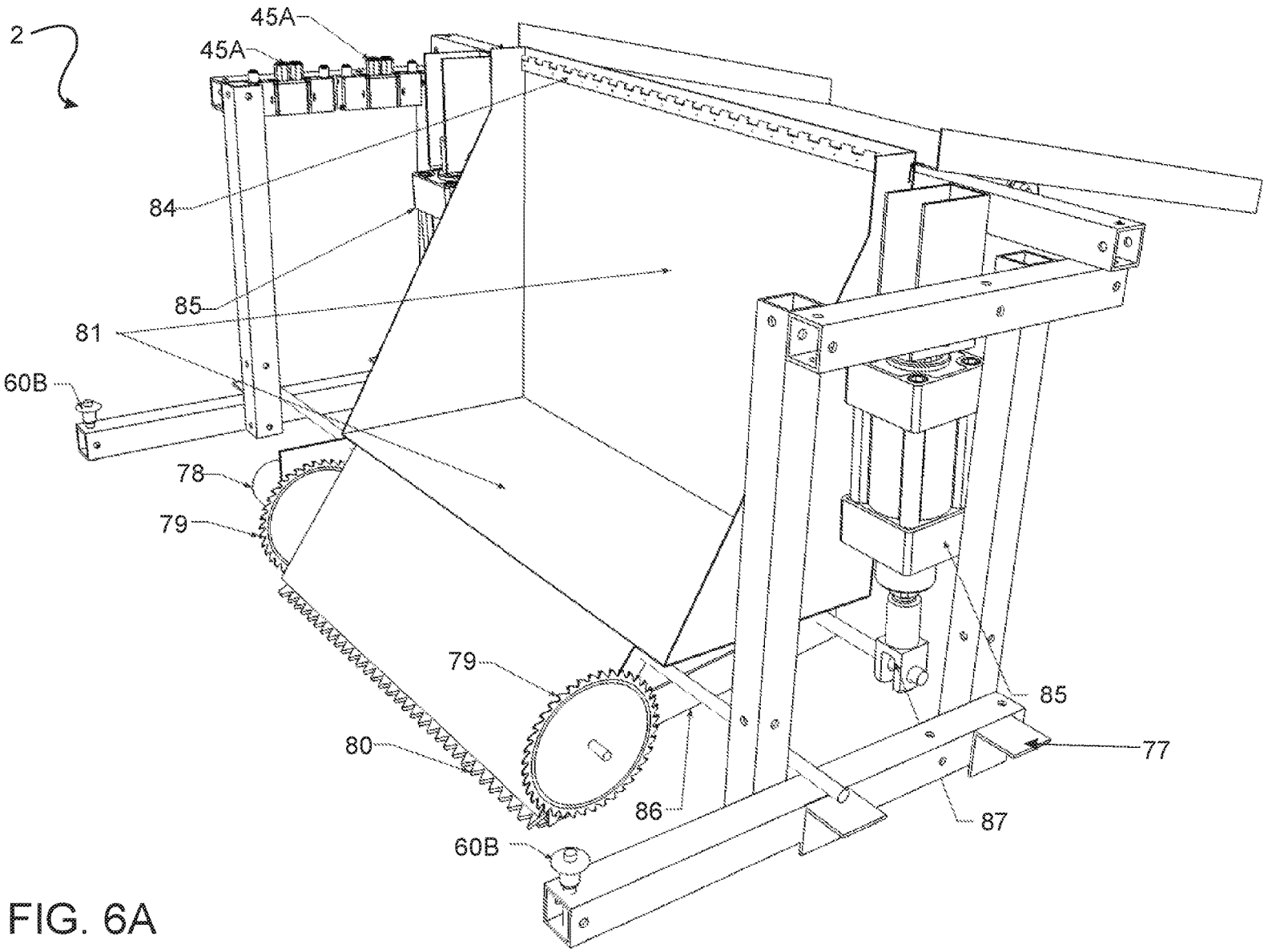
FIG. 6A is a top perspective view of a roof shingle removal apparatus according to an embodiment of the present invention.
Figure 6B:
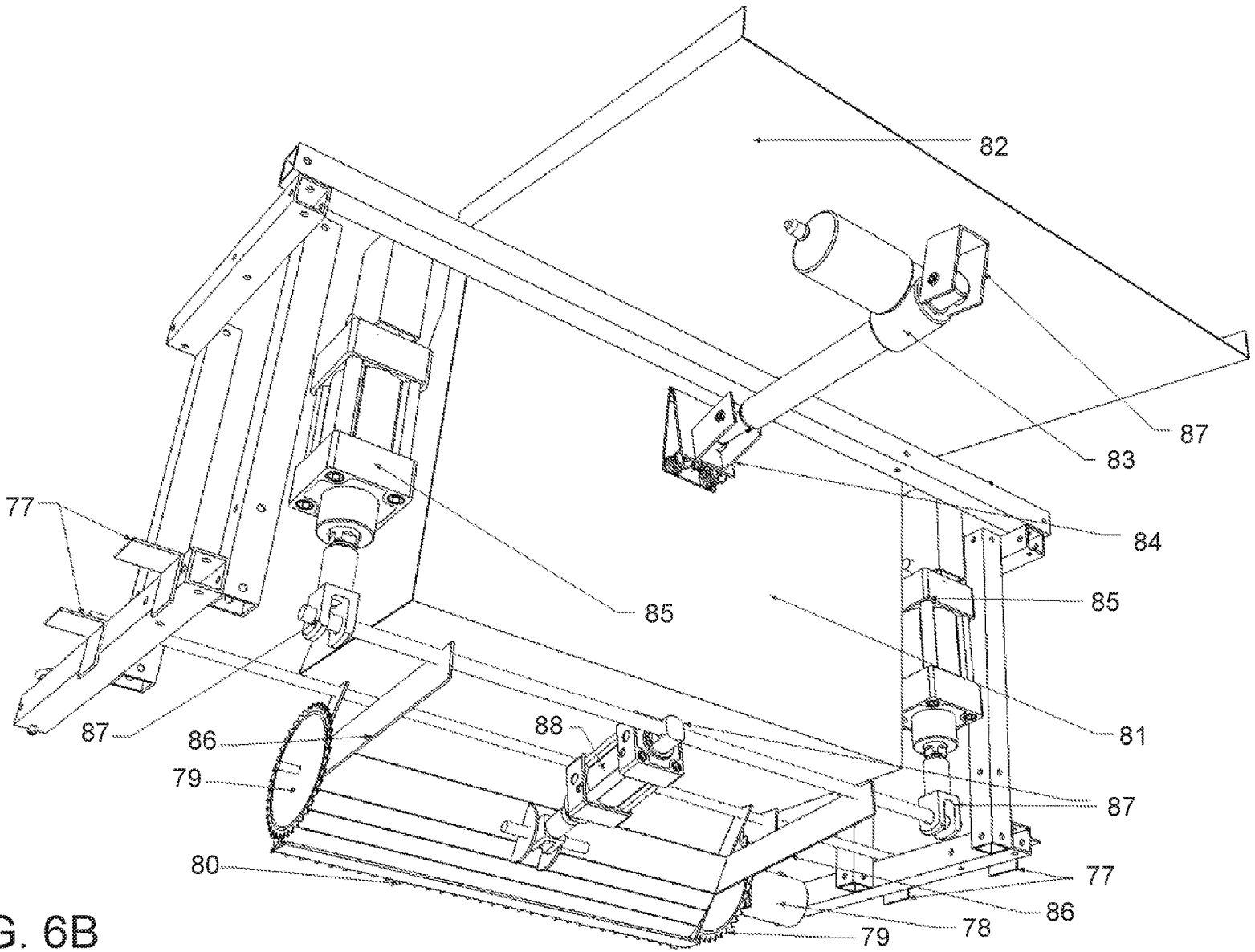
FIG. 6B is a bottom perspective view of the roof shingle removal installation apparatus according to an embodiment of the present invention.
Figure 7A:
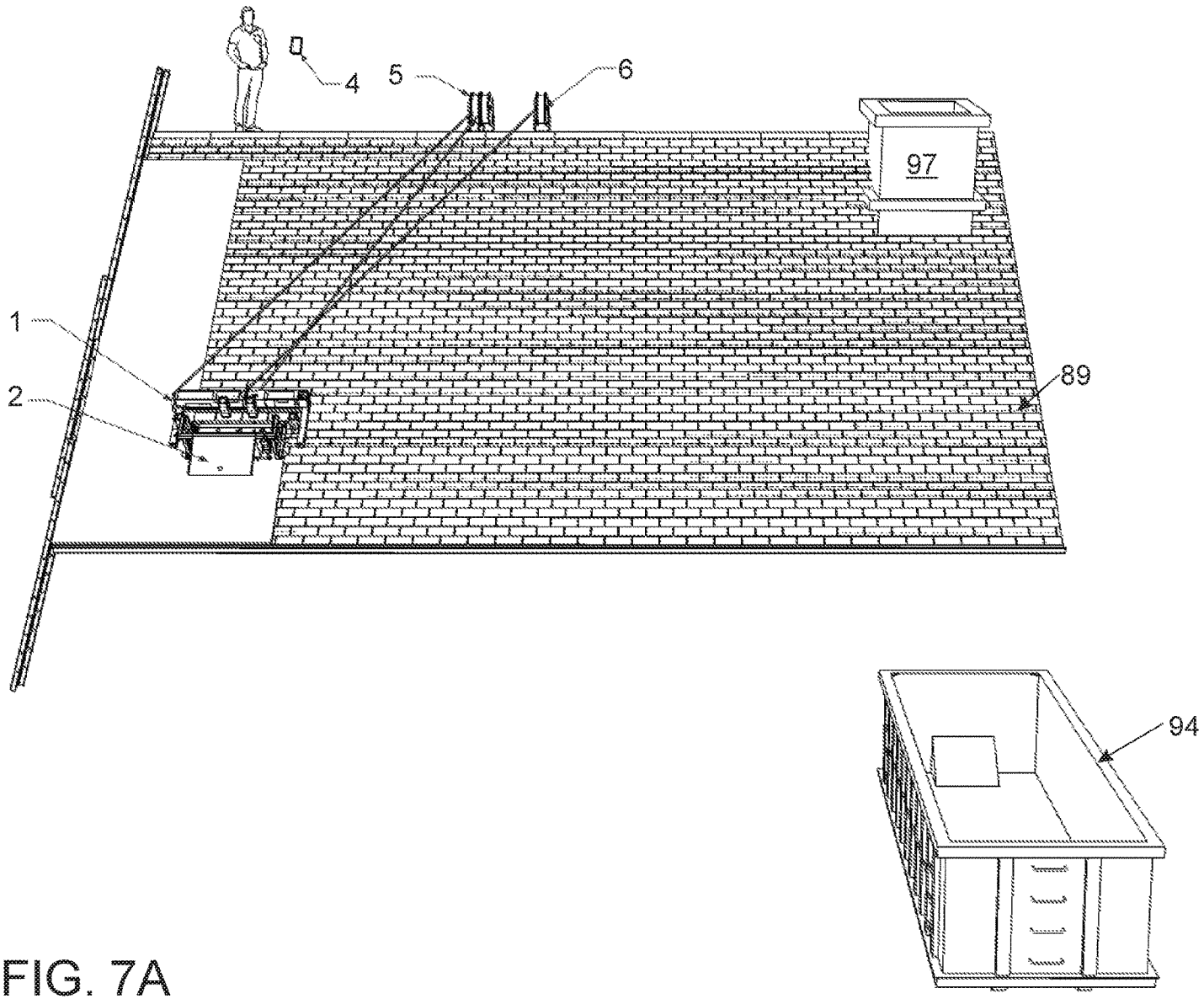
FIG. 7A illustrates the removal of existing shingles using the system according to an embodiment of the present invention.
Figure 7B:
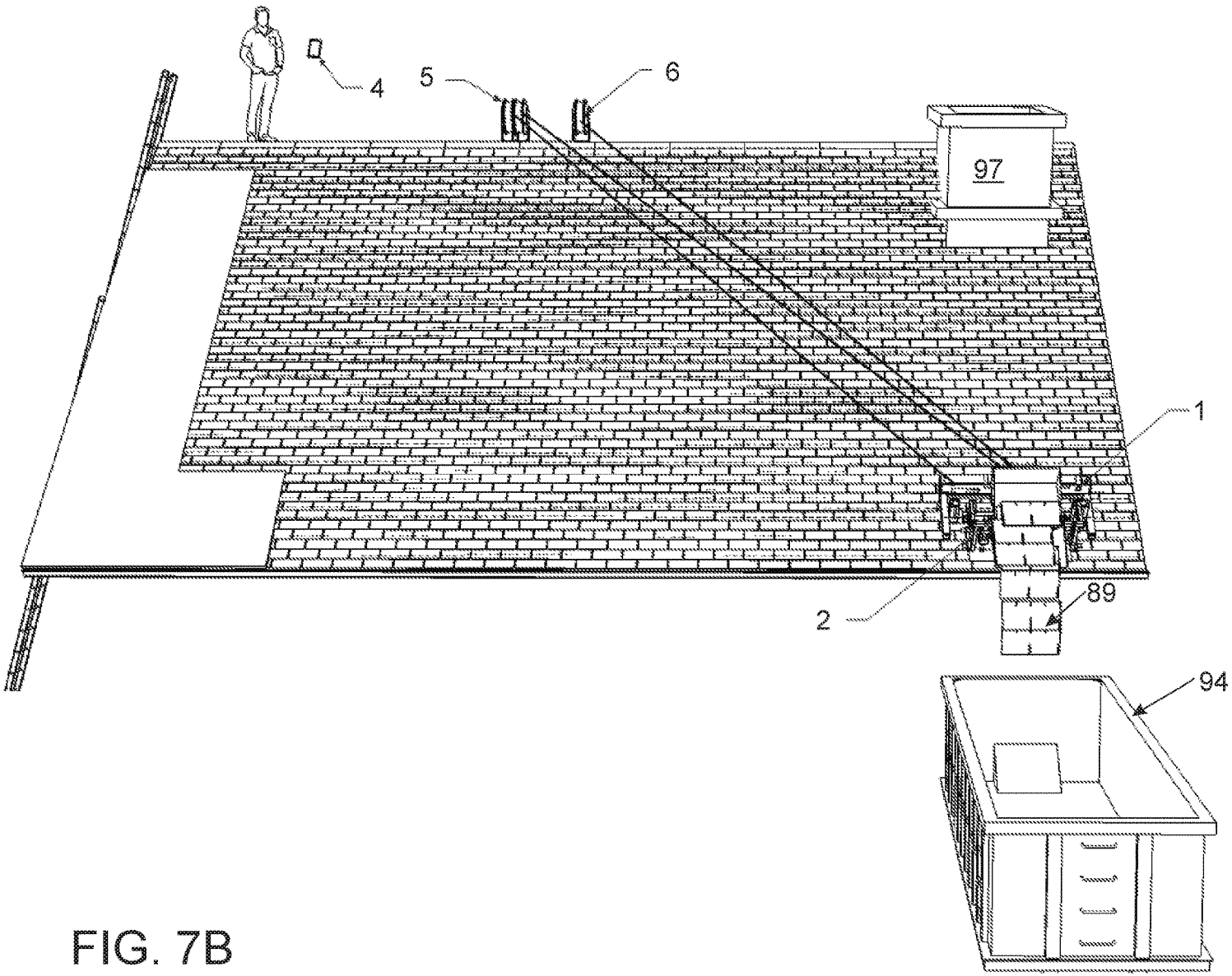
FIG. 7B illustrates a depositing method of the existing shingles using the system according to an embodiment of the present invention.
Figure 7C:
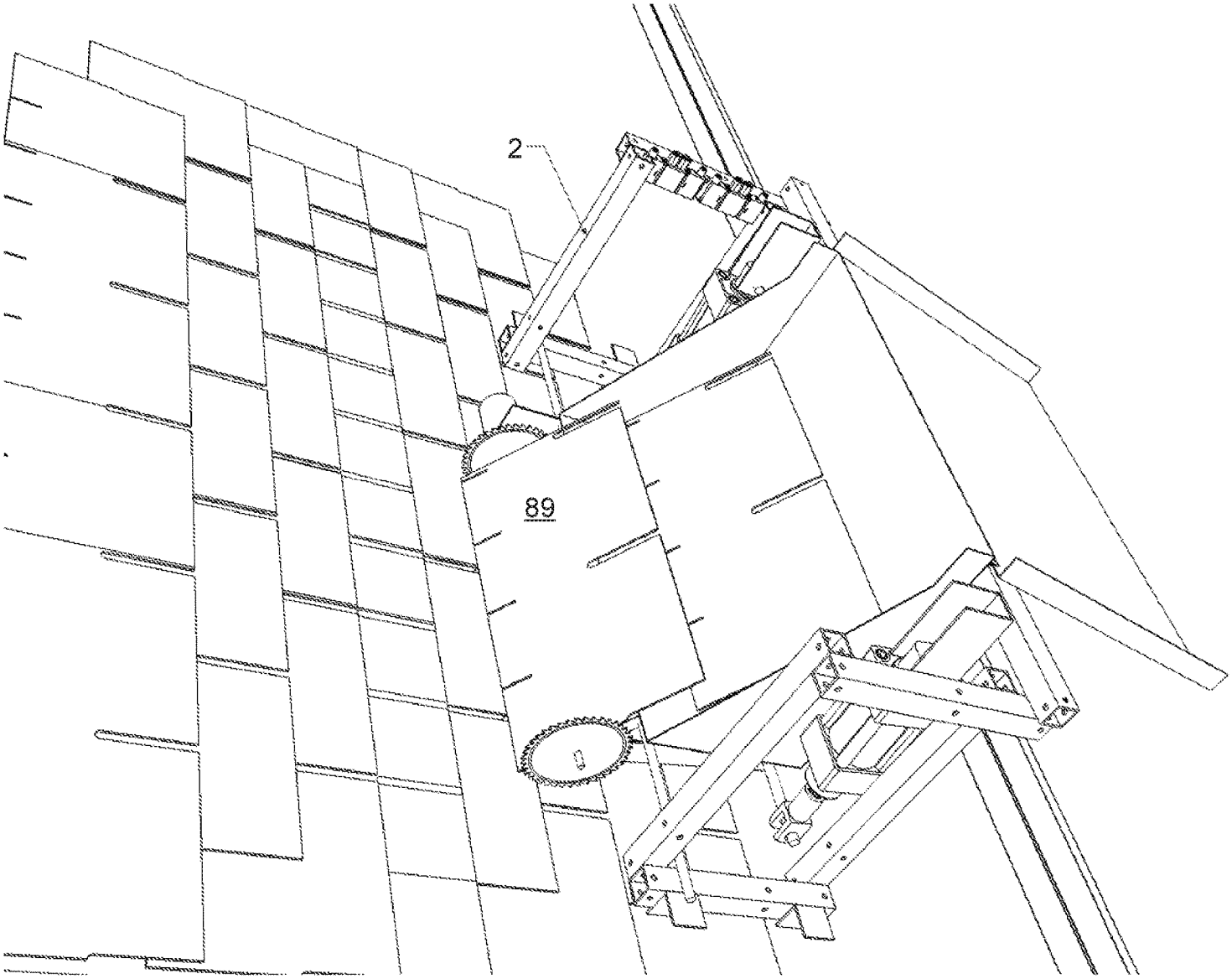
FIG. 7C is a detailed view of the removal of existing shingles using the system according to an embodiment of the present invention.
Figure 7D:
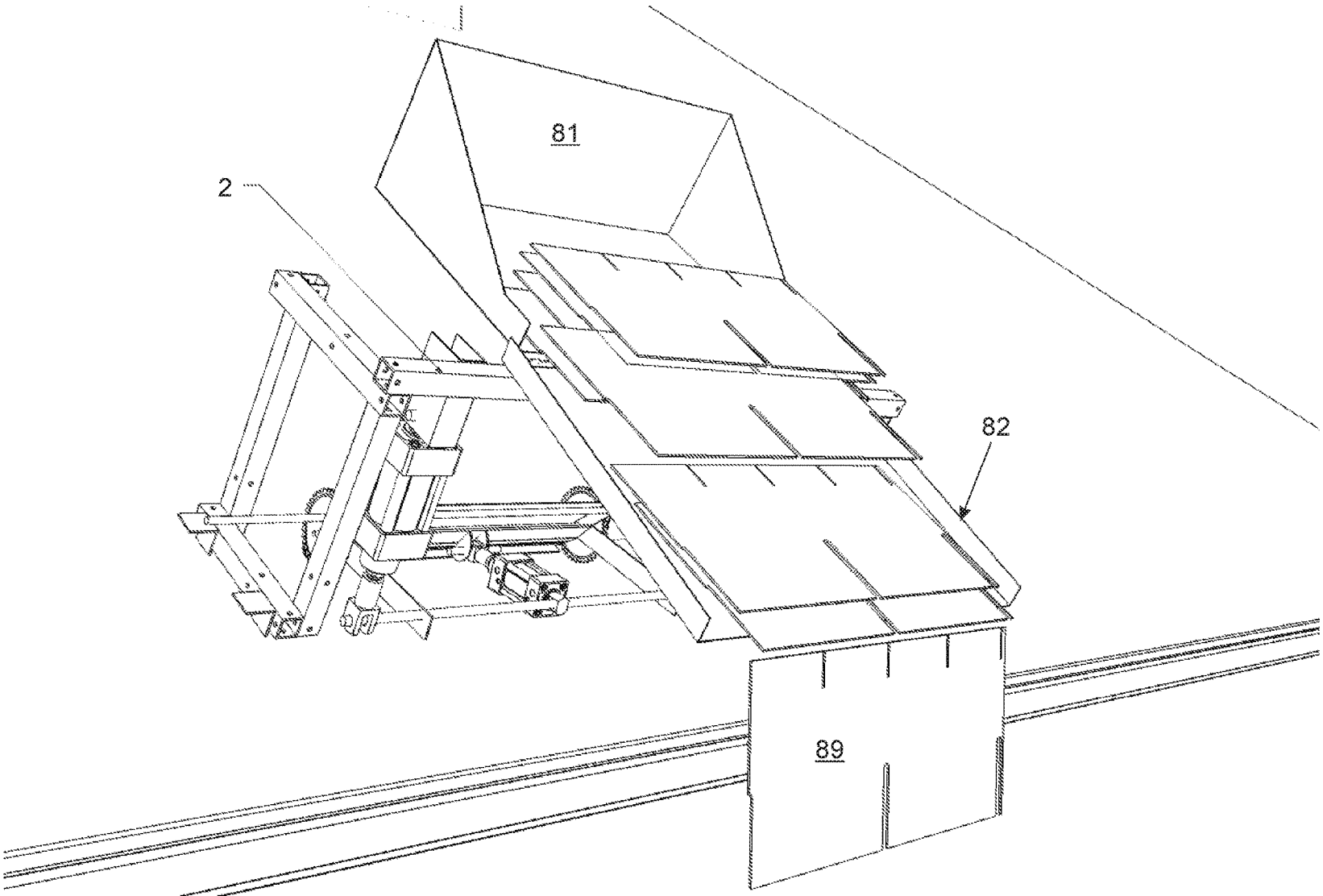
FIG. 7D is a detailed view of the depositing method of the existing shingles using the system according to an embodiment of the present invention.

FIGS. 6A-B are various perspective views of a roof shingle removal apparatus 2 according to an embodiment of the present invention. Referring now to FIGS. 6A-B, the roof shingle removal apparatus is illustrated. The roof shingle removal apparatus includes quick release cotter pins 60B to attach to the roof shingle removal apparatus to the navigational apparatus. In one embodiment, a plurality of L-shaped brackets 77 allows the shingle removal apparatus to rest and slide along the navigational apparatus. The roof shingle removal apparatus is configured to cut and remove old existing shingles from the roof using cutting wheel blades 79, wherein the cutting wheel blades are powered and rotated via motor 78. During operation, a pry bar 80 positioned between the cutting wheel blades is configured to pry old existing shingles from the roof. Specifically, the old existing shingles and old nails are removed from the roof using the pry bar which is levered via leverage bar 86 and pushed forward via air cylinders 85 and 88 respectively. Air cylinder 88 provides the necessary force to get the pry bar under the existing shingles and nails, wherein the air cylinders 85 are actuated with solenoids 45 to lever the pry bar up off the roof such that the old existing material is removed and collected into a debris bin 81. In one embodiment, the debris bin is configured to be raised via linear actuator 83 allowing the debris to be dumped into a debris collection container 94 (FIG. 7). A debris shoot 82 positioned on the top of the apparatus allows the debris to clear gutters when dumping. A mounting bracket 87 positioned on the back side of the debris shoot is configured to hold one side of the linear actuator which is connected to the back of the debris bin with a piano hinge 84 on the other side, wherein the piano hinge enables the debris bin to be raised and lowed.

FIGS. 7A-D illustrate the removal of existing shingles 89 using the system according to an embodiment of the present invention. Referring now to FIGS. 7A-D, roof shingle removal apparatus 2 attached to navigational apparatus 1 controlled and monitored by a user via mobile device 4 removes the existing shingles using vertical passes, then deposits the existing shingles into debris collection container 94 as previously mentioned. The provided proximity sensors and the microcontroller enable the system to located the debris collection container, and place debris in the collection container as the system traverses and removes the existing shingles. In one embodiment, the user will use the mobile device to set coordinates consisting of the length and width of the roof as well as any obstruction 94, such as chimneys, plumbing vents, or skylights. Likewise, the debris collection container coordinates can be set using the mobile device. It is a particular advantage of the present invention to target the debris in a specific location, since obstructions such as porches or flowers may exist below the roof line.

FIGS. 8A-G illustrate the installation of new shingles 89A using the system according to an embodiment of the present invention. Referring now to FIGS. 8A-D, roof shingle installation apparatus 3 attached to navigational apparatus 1 controlled and monitored by a user via mobile device 4, installs new shingles in horizontal lines along the roof starting from the bottom of the roof. It is a particular advantage of the invention, that each pneumatic nailer gun 41 is independently actuated, allowing the system to leave one nail unfastened along obstructions such as chimneys, stacks, and dormers so the user, such as a roofing contractor, can flip up the edge and apply metal flashing and tar as well known in the art. This precise placement or non-placement of fasteners is critical, as building codes require different nail placement depending on the geographic location or municipalities. Further, shingle manufacturer installation specifications require different nail placements. Thus, the advantageous nailer guns make it possible for any installation requirements. In one embodiment, using the mobile device the user will set coordinates and specify where metal flashing is need around any obstruction 97. In one embodiment, the user device will also notify the user when additional roof materials and nails are needed. The user has the ability to specify a location for reloading materials, which is advantageous as the user can stay in a safe location, usually at the peek of the roof 89 without the need to set up scaffolding to access the apparatus due to the steepness of the roof. As previously mentioned, it particular advantage of the present invention that the system has the ability to overhang the roof maximizing the operational surface area enabling the removal and installation of an entire row of shingles.

It is also a particular advantage of the present invention that the weight of each component of the system and each apparatus can be attached to the roof and is also light enough to use a standard boom lift often used to lift shingles onto the roof as well known in the art. Further, in some instances the bundles of shingles may be manually carried up a ladder as well known in the art. Other methods, such as cranes and pulley may also be used. A bundle of shingles weighs approximately 70 pounds. The total weight of the present invention is at most 200 pounds, wherein each apparatus of the system is 60 pounds or less, thus users can use the standard boom lift or other methods known in the art to raise the bundle of shingles on the roof for each component of the system as well.

It is also a particular advantage of the present invention that the navigational apparatus can traverse a variety of roof types such as a hip roof and avoids a variety of obstructions including but not limited to chimneys, skylights, and dormers without the use of guide rails, pulleys, or armatures.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention. For instance, although a pneumatic system is disclosed an electric system may be provided without departing from the spirit and scope of the invention. Another variation may include a single integral unit comprising each apparatus described. However, as previously mentioned limiting the weight of the system is critical since the system needs to be lifted onto a roof during use. Therefore, the aforementioned design feature wherein each component is a separate component is ideal. Then, the components may be assembled on the roof prior to operation.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group

What is claimed is:

1. An automatic roof shingle removal system comprising:

a navigational apparatus configured to traverse a roof without the use of guide rails, wherein the navigational apparatus comprises a structural body housing an integrated circuit comprising a microcontroller, a gyroscope, and an accelerometer; and, a roof shingle removal apparatus comprising a prying member configured to pry existing shingles from the roof, wherein the existing shingles pried from the roof are stored in a debris bin, wherein the navigational apparatus comprises at least one movable drill assembly including at least one independently actuated drill configured to drill a lag screw into the roof preventing the navigational apparatus from slipping off the roof, and a mounting element configured to attach the roof shingle removal apparatus to the navigational apparatus such that the roof shingle removal apparatus is enabled to traverse the roof via the navigational apparatus, and wherein the at least one movable drill assembly is a movable horizontal drill assembly and a movable vertical drill assembly, wherein the movable horizontal drill assembly and the movable vertical drill assembly each include two independently actuated drills.

2. The automatic roof shingle removal system of claim 1, wherein the debris bin can be raised and lowered such that the existing shingles may be emptied in a precise location.

3. The automatic roof shingle removal system of claim 1, wherein the navigational apparatus is controlled and monitored by a user via a mobile device.

4. The automatic roof shingle removal system of claim 1, wherein the navigational apparatus further comprises proximity sensors configured to detect an edge of the roof and a plurality of wheels, wherein the at least one movable drill assembly, the proximity sensors, and a position of the plurality of wheels enable the navigational apparatus with the roof shingle removal apparatus attached to overhang an edge of the roof allowing for the removal of existing shingles on the edge of the roof.

5. The automatic roof shingle removal system of claim 1, wherein the roof shingle removal apparatus further comprises at least one cutting element configured to cut the existing shingles from the roof.

6. The automatic roof shingle removal system of claim 4, wherein the microcontroller enables the navigational apparatus with the attached roof shingle removal apparatus to locate a position of a debris collection container on a ground surface adjacent to the edge of the roof such that the existing shingles stored in the debris bin can be dumped into the debris collection container when the debris bin is raised via a linear actuator.

7. The automatic roof shingle removal system of claim 6, wherein the roof shingle removal apparatus further comprises a debris shoot positioned at a top portion of the debris bin allowing the existing shingles to clear gutters when dumped into the debris collection container.

8. The automatic roof shingle removal system of claim 1, wherein the gyroscope is configured to detect an angle of the navigational apparatus and the microcontroller can fasten one of the two independently actuated drills of the vertical drill assembly, and push the navigational apparatus back into a level horizontal position such that the navigational apparatus is auto-leveling ensuring the navigational apparatus traverses in straight lines.

9. The automatic roof shingle removal system of claim 1, further comprising an auto-retractable lifeline safety harness, wherein the auto-retractable lifeline safety harness is configured to attach to the navigational apparatus as a safety measure in case the navigational apparatus becomes detached from the roof unexpectedly.

* * * * *